US008541076B2

(12) United States Patent
Chien

(10) Patent No.: US 8,541,076 B2
(45) Date of Patent: Sep. 24, 2013

(54) STRETCHABLE HIGH-LOFT FLAT-TUBE STRUCTURE FROM CONTINUOUS FILAMENTS

(75) Inventor: Tomas Jung-Fu Chien, Montebello, CA (US)

(73) Assignee: V.F.T. Inc. CA (US)

( * ) Notice: Subject to any disclaimer, the term of this patent is extended or adjusted under 35 U.S.C. 154(b) by 911 days.

(21) Appl. No.: 10/751,910

(22) Filed: Jan. 7, 2004

(65) Prior Publication Data

US 2005/0147775 A1 Jul. 7, 2005

(51) Int. Cl.
*B32B 1/08* (2006.01)
*B32B 23/00* (2006.01)

(52) U.S. Cl.
USPC ..... 428/34.7; 428/34.1; 428/34.2; 428/35.7; 428/35.9; 428/36.9

(58) Field of Classification Search
USPC ..... 428/34.1, 35.7, 35.9, 36.9, 34.2, 428/34.7
See application file for complete search history.

(56) References Cited

U.S. PATENT DOCUMENTS

| | | | | |
|---|---|---|---|---|
| 3,492,185 | A | 1/1970 | Burger | |
| 3,515,621 | A | 6/1970 | Watson | |
| 3,747,162 | A | 7/1973 | Watson | |
| 4,624,879 | A * | 11/1986 | Van Dijck et al. | 428/102 |
| 4,761,872 | A * | 8/1988 | Buettner et al. | 29/451 |
| 4,999,232 | A * | 3/1991 | LeVan | 428/113 |
| 5,110,383 | A * | 5/1992 | Kramer | 156/88 |
| 6,550,107 | B1 | 4/2003 | Jourde et al. | |
| 6,706,393 | B2 * | 3/2004 | Raskin et al. | 428/357 |
| 2002/0153641 | A1 * | 10/2002 | Hernandez et al. | 264/442 |

FOREIGN PATENT DOCUMENTS

| | | | |
|---|---|---|---|
| EP | 0 343 978 | A | 11/1989 |
| WO | WO 93/00464 | A | 1/1993 |
| WO | WO 98/37264 | A | 8/1998 |
| WO | WO 02/070806 | A | 9/2002 |

* cited by examiner

*Primary Examiner* — Marc Patterson
(74) *Attorney, Agent, or Firm* — Bacon & Thomas, PLLC

(57) ABSTRACT

Improved batts for sleeping bags, insulated apparel, bedding, and other uses are made from a tow of crimped continuous filaments by a machine and process which spreads, extends, and wraps the tow into an endless flat-tube structure with desired uniformity, balanced tensile strength, dimensional stability, stretchability, and high loft.

13 Claims, 18 Drawing Sheets

STRETCHABLE HIGH-LOFT FLAT-TUBE STRUCTURE FROM CONTINUOUS FILAMENTS

FIELD OF INVENTION

This invention is concerned with improvement in fiberfill batts, sometimes referred to as batting, and processes whereby such improved bans with desirable uniformity, balanced tensile strength in all directions, stretchability, and high loft may be obtained.

DESCRIPTION OF RELATED ART

U.S. Pat. No. 3,747,162 issued to Watson on 24 Jul. 1973 discloses a conventional apparatus for producing a cross-lapped structure of crimped continuous filaments. This conventional apparatus includes a banding device, a threaded roll device, a series of air spreaders, a pair of delivery rolls, a pair of rolls, a chute, a pneumatic or hydraulic cylinder, and an apron.

A tow of some 30,000 adjacent crimped continuous filaments is delivered from a container (not numbered) to the banding device. From the banding device, the tow is delivered to the threaded roll device, where the crimped continuous filaments are de-registered. From the threaded roll, the crimped continuous filaments are delivered to the air spreaders, where air jets are used to spread the crimped continuous filaments to form a spread web. From the air spreaders, the spread web is delivered to the delivery rolls, about which the spread web makes an S-wrap. From the delivery rolls, the spread web is delivered to the pair of rolls, where the spread web makes an S-wrap. From the rolls, the spread web is delivered to the chute made of doors. The chute is oscillated via the pneumatic or hydraulic cylinder connected with one of the doors. From the chute, the spread web is laid onto the apron in the form of a roll-driven endless belt. The oscillated chute and the roll-driven endless belt together produce a cross-lapped structure of crimped continuous filament. In the use of this conventional apparatus, several problems have been encountered. Firstly, after leaving the chute, the spread web billows out transversely. This makes the spread web thinner towards its lateral edges.

Secondly, the chute is oscillated, i.e., the lower end of the chute is reciprocated between two dead ends.

The speed of the lower end of the chute reaches its minimum value, i.e., 0, at two end points of its travel, and reaches its maximum value at a midpoint between the end points. By doing so, the lower end of the chute stays longer at the end points than at the midpoint. Since the spread web is delivered at a constant rate, the chute releases more weight of less-extended crimped continuous filaments when reaching the end points than when reaching the midpoint. Hence the cross-lapped structure is thinner along a midline than along the two sides. Thirdly, since the speed of the lower edges of the doors is much greater than that of a point of the roll-driven endless belt, the cross-lapped intersect angle between layers of spread web is very small. In other words, the spread web from crimped continuous filaments actually extends substantially transverse to a longitudinal direction, or machine direction (MD), of the cross-lapped structure. Thus, little strength is provided in the machine direction of the cross-lapped structure. Furthermore, the cohesion between layers of spread web in the cross-lapped structure is poor, and they cannot adequately hold on to each other. The cross-lapped structure also exhibits poor dimensional stability, especially along the midline where the weight and thickness are lowest. Therefore, resin bonding, needle punching, or thermal bonding must be used to minimize these problems.

The present invention is therefore intended to obviate or at least alleviate these problems.

SUMMARY OF THE INVENTION

The present invention provides a new machine and process to make a wrapped flat-tube structure or batting of crimped continuous filaments with optimum balance of tensile strength in all directions, especially in machine (MD) and cross-machine (CD) directions, with good stretch recovery properties, dimensional stability, and high loft, and overcomes the important deficiencies mentioned above in the prior art.

This invention uses crimped continuous filaments tow band wrapping at constant tension and speed around a batt-forming device which spreads, extends, and wraps this tow continuously to form a uniform batting having balanced tensile strength and to provide structural stability and stretch recovery properties. Uncrimped continuous filaments having extendible properties, such as elastic fibers or latent crimped fibers, etc., which can be spread, extended, and wrapped can also be used with this invention. By adjusting the traveling speed of the tow band wrapping around the batt-forming device and the spread belt surface speed in the spreading zone as described below as a spread ratio in the batt-forming device, the fiber orientation can achieve between a 10- and 70-degree angle, preferably a 30- to 60-degree angle, vs. the CD direction, and achieve a fiber orientation between layers of close to a 20- to 140-degree angle, preferably a 60- to 120-degree angle. As an example, when the traveling speed of the tow band wrapping around the batt-forming device and the spread ratio are optimized, the fiber orientation can be maintained at about a 45-degree angle vs. the CD direction, and the fiber orientation between layers at close to a 90-degree angle. This combination of fiber orientation in a spread flat-tube structure provides the best balance in MD and CD strength with a ratio of 1:1 so that there are essentially no weak spots in the flat-tube structure regardless of which direction the structure is pulled. The resulting flat-tube structure also exhibits excellent stretch recovery properties, dimensional stability, and high loft. Since the structure is formed from continuous filaments into an endless flat tube with good cohesion between individual fibers and between spread tow layers, one can use it directly without additional bonding process for insulated apparel, sleeping bags, bedding articles, and furniture applications, thus eliminating the deficiencies of the conventional cross-lapped batting made by the prior art mentioned above.

The advantage of wrapping the batt-forming device under constant tension and speed throughout the spreading, extending, and wrapping process eliminates the deficiency of the prior art of forming a thinner web on the lateral edges and the weight uniformity problem, especially in the midline of the final batting. By adjusting the traveling speed of the feeding device and the spread ratio of the forming device, a complete balance of the tensile strength and stretchability in MD and CD directions can be achieved, hence eliminating the deficiencies of the prior art, which has poor tensile strength and dimensional stability in the MD, or longitudinal, direction. Also the need for resin bonding, needle punching, or thermal bonding to improve cohesion between layers in the conventional cross-lapped structure can be eliminated, resulting in a stretchable, softer, and thicker structure to improve the aesthetics and warmth of the sleeping bags, insulated apparel, etc. These aspects of the present invention may be used separately or in combination to solve deficiencies of the conventional cross-lapped structure.

Because of the unique fiber orientation achieved by this invention and the precision control of the batting width, the flat-tube structure maintains the strength advantage of the spun bonded fabric but with improved stretchability, loft, and softness vs. spun bonded fabric. No resin, or thermal bonding, or mechanical entanglement such as needle punching is required for the flat-tube structure of this invention. If desired, one can also use the above conventional bonding processes to even further increase the batting strength but with increased stiffness.

Because the structure by this invention is formed under pre-determined constant tension and precise mechanically controlled spreading, extending, and wrapping, the stress applied on each filament is similar. Once the structure is released from the spread belt and is delivered to the conveyor, it maintains its dimensional stability and uniformity in this relaxed state. This flat tube structure can be used for insulated apparel, sleeping bags, bedding, and furniture applications without further bonding steps such as resin bonding, needle punching, and thermal bonding with low-melting binder fiber, which normally reduce softness and/or loft. Due to the unique stretchability property of the flat tube structure of this invention, it can easily regenerate its loft and resiliency from compression during shipping and storage by slightly stretching or fluffing the final products. Particularly useful when a stretchable cover fabric or shell fabric is used is the ability of the flat-tube structure of this invention to conform to the stretching of the fabric without deterioration. The conventional resin bonded, needle-punched, and thermally bonded batting or cross-lapped structure cannot provide this regeneration property because individual fibers and cross-lapped layers are bonded and locked with each other and are not free to separate from the compressed bonded structure.

The differences between the flat-tube structure of this invention and spun bonded fabric are significant. The present invention allows fiber orientation at a 45-degree angle vs. the CD direction and a 90-degree angle between layers of spread tow for balanced strength. The resulting structure can be used directly without bonding vs. spun bonded batting, which must be bonded to stabilize the structure. Hence the flat-tube structure of this invention is softer and provides higher loft. In addition, the continuous filaments used in this invention can be crimped as an option vs. no crimp for spun bonded filaments directly extruded from spinnerets, therefore exhibiting its stretch recovery properties. Spun bonded battings are limited to low fiber orientation angles, no crimp in each filament, and a rigidly bonded structure leading to rigid and low-loft nonwoven fabric or batting.

As will be described below, the unique design of the batt-forming device allows multiple numbers of tows of crimped continuous filaments to be simultaneously fed onto the feeding zone and subsequently to be spread in the spreading zone. If desired, each tow fed from a different feeding device can be different in fiber type, denier, fiber cross-section, and other variables, resulting in a heterogeneous batt in one single step by the present invention, whereas an expensive multiple-step process or complicated layering mechanism is required to achieve a similar composition by other methods. Almost any kind of fiber, such as nylon, polyester, polypropylene, and elastic fibers, just to name a few, can be used in this invention. There is no fiber denier limitation in this invention. Various cross-sections of fiber, for example, round, trilobal, tetralobal, etc., can be used with this invention. Other variables, such as fiber surface modification, additive in polymer, etc., to provide special properties or functions in the batting can be used with the present invention.

BRIEF DESCRIPTION OF DRAWINGS

The present invention will be described through a detailed illustration of embodiments, referred to in the attached drawings.

DETAILED DESCRIPTION OF THE INVENTION

Figure 1:
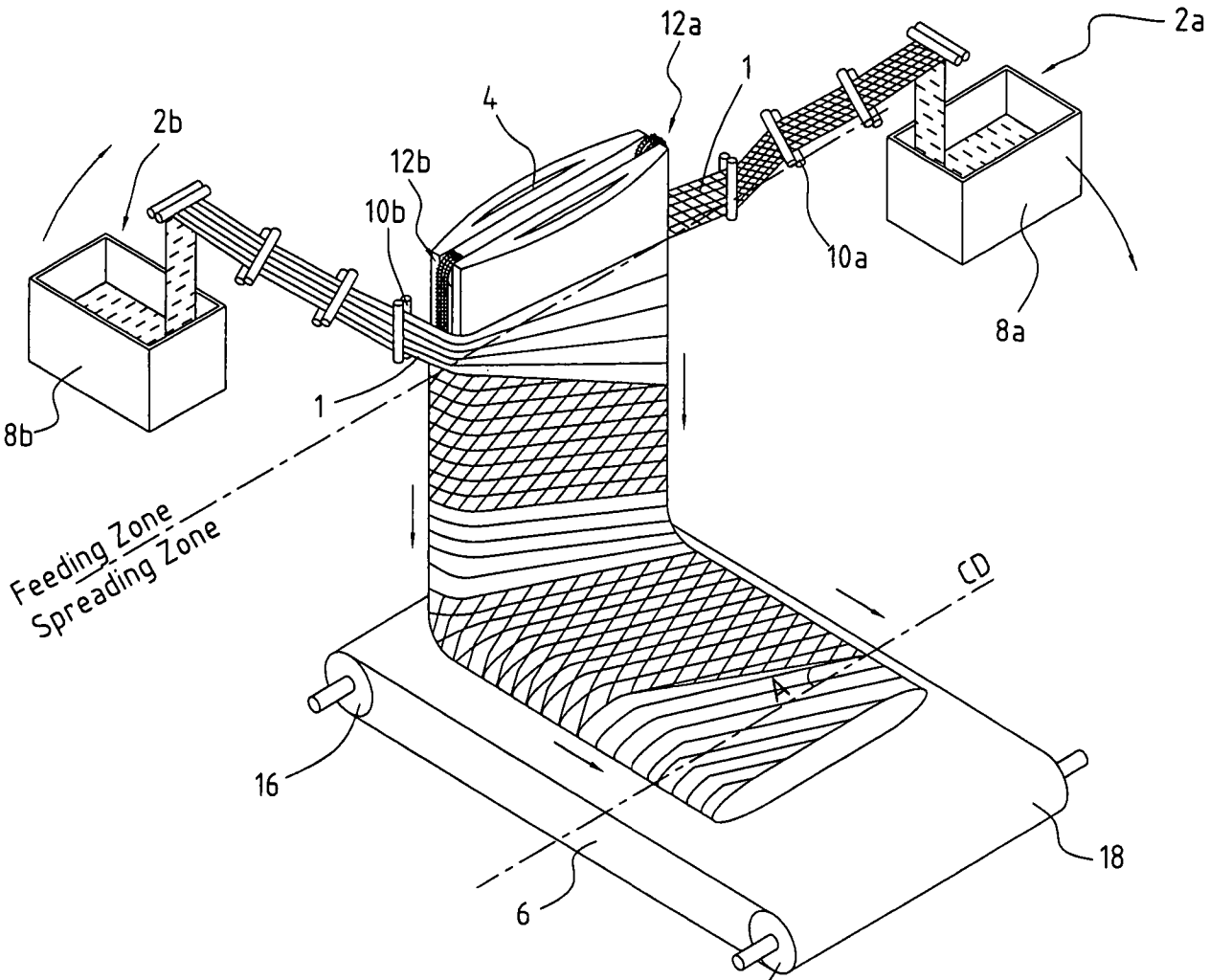
FIG. 1 perspective view of the machine for producing a flat-tube structure from two tows of crimped continuous filaments according to the first embodiment of the present invention.

Referring to FIG. 1, according to the first embodiment of the present invention, a machine and process for producing a flat-tube structure of crimped continuous filaments includes two separate feeding devices 2*a* and 2*b* located 180 degrees apart from one another; a spreading, extending, and wrapping device 4, which will be called the batt-forming device 4; and a conveying device 6. A tow 1 of crimped continuous filaments is fed from each of the feeding devices 2*a* and 2*b* to the batt-forming device 4, where the tow 1 is spread, extended, and wrapped. From the batt-forming device 4, a flat-tube structure of crimped continuous filaments is delivered to the conveying device 6 and subsequently to the windup equipment.

The feeding devices 2*a* and 2*b* each consist of a container 8*a* and 8*b* respectively in which the tow is stored and a series of rolls 10*a* and 10*b* respectively for spreading and feeding the tow 1 from the containers 8*a* and 8*b* to the batt-forming device 4. Although not shown, a mechanism is used to carry and drive the feeding devices 2*a* and 2*b* wrapping around the batt-forming device 4 continuously either in a clockwise or counter-clockwise direction for producing a continuous flat-tube structure of crimped continuous filaments. Such a mechanism is not shown since it is not the spirit or an essential part of the present invention.

Figure 2:
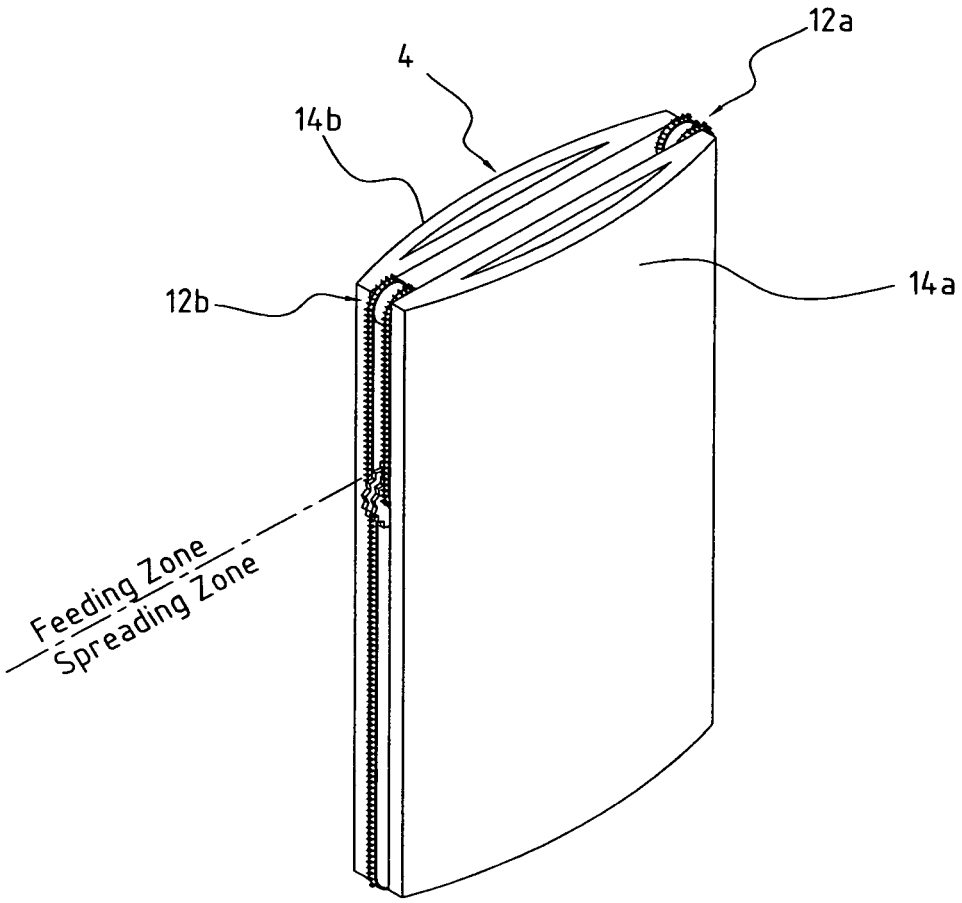
FIG. 2 front view of a batt-forming device used in the machine of FIG. 1.
Figure 3:
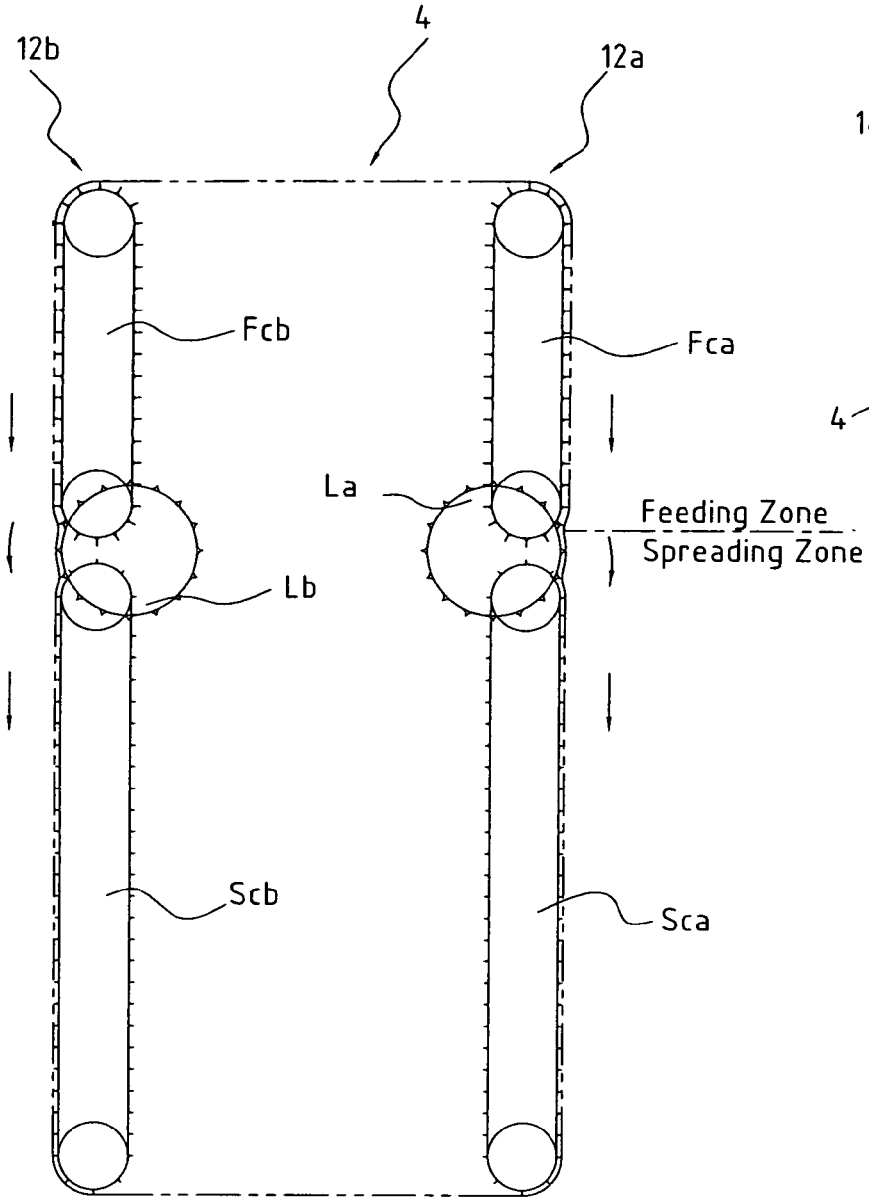
FIGS. 3 and 4 front and side views of the components of a batt-forming device used in the machine of FIG. 1.
Figure 4:
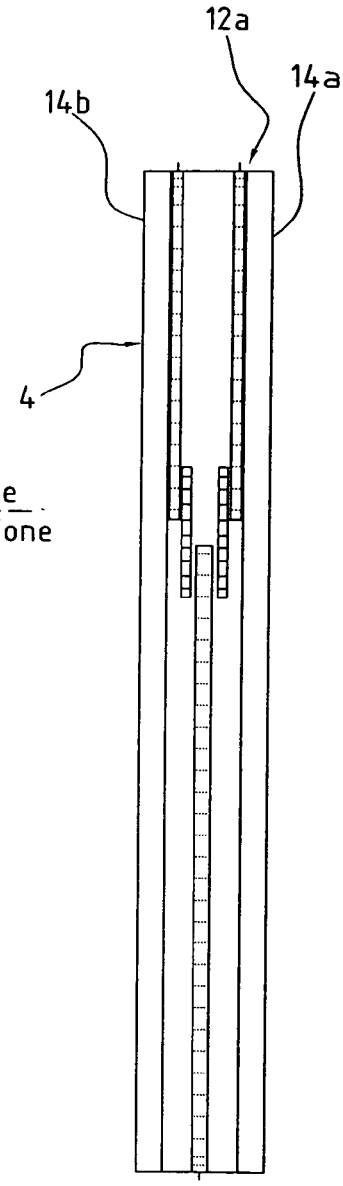

Referring to FIGS. 2 to 5, the batt-forming device 4 includes two groups of pin-covered conveyors 12*a* and 12*b*, and two curved plates 14*a* and 14*b* between which the two groups of conveyors are arranged. The first group 12*a* is arranged near one edge of each of the plates 14*a* and 14*b*, and the second group 12*b* is arranged on the opposite edge of each of the plates 14*a* and 14*b*. Each group of the conveyors 12*a* and 12*b* extend a portion beyond the edges of plates 14*a* and 14*b* for engagement with the tows 1 of crimped continuous filaments, which are wrapped around the batt-forming device 4. As shown in FIGS. 3 and 4, 12*a* and 12*b* each consist of two groups of conveyors. A slower-moving conveyor is in the feeding zone located in the upper section of the batt-forming device 4, and a faster-moving conveyor in the spreading zone is located in the lower section of the batt-forming device 4. As shown in FIGS. 3 and 4, the conveyors in the upper section of the batt-forming device 4 within the feeding zone, indicated as Fca and Fcb, which comprise two separate but identical conveyors, are driven by rolls of slower but identical rotating speed in both 12*a* and 12*b*. Therefore, the surface speeds of conveyors in the feeding zone are identical at 12*a* and 12*b*. The advantage of the two separate conveyors in the feeding zone is to provide additional anchor points and supports of the engaged tow band in the feeding zone so that they can prevent a potential filament entanglement problem within the tow band during the engaging and transferring processes within the feeding zone. These two conveyors identified in each of Fca and Fcb respectively as shown have identical construction and surface speed, and the conveyors are parallel to each other. The conveyor belt surfaces are covered with coarse pins extended on the surfaces to provide enough friction to hold filaments of the tow 1 in place and transport them to the spreading zone. Because there are two conveyors for each side of the feeding zone, there are also two corresponding pin-wheels for each of La and Lb respectively at the bottom of each conveyor Fca and Fcb in the feeding zone in 12*a* and 12*b* having fine pins on the surface with surface speed faster than that of the conveyors in the feeding zone to pick up filaments from the respective conveyors as shown in FIGS. 3 and 4.

As the tow 1 of crimped continuous filaments is engaged by coarse pins on the conveyors Fca and Fcb in the feeding zone and moved downward at slow speed, filaments maintain their positions parallel to each other in the tow 1 without separation or spreading. When the leading edge of the tow 1 reaches the joining line between the bottom of Fca and Fcb and the pin-wheels La and Lb, the filaments in the leading edge of the tow 1 are caught by fine pins on the surface of the fast-rotating pin-wheels La and Lb.

Figure 5:
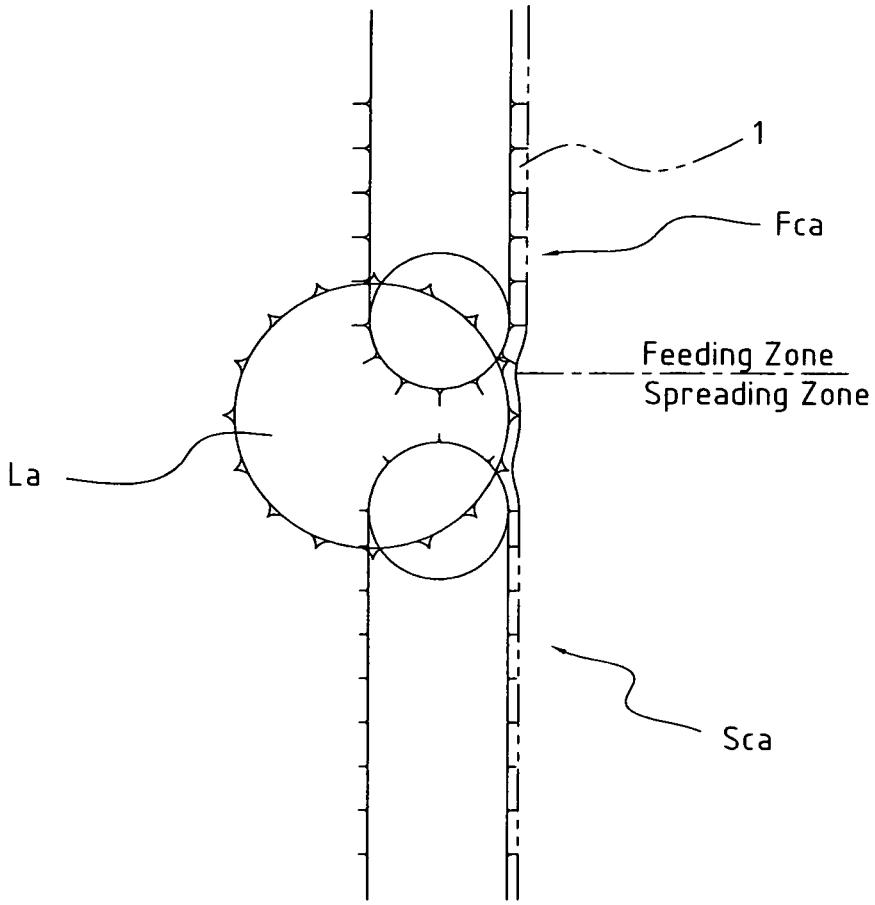
FIG. 5 enlarged sectional view of a pinwheel between the conveyers of the feeding zone and the spreading zone as used in the machine of FIG. 1.

FIG. 5 shows that, because the surface speed of the pin-wheel La is faster than that of the conveyor Fca in the feeding zone, the filaments are caught and picked up from the tow band and are separated from the majority of the filaments in the tow 1, which is still being held by coarse pins on the conveyors in the feeding zone. In a continuous operation, the rest of the tow band is moved downward continuously by conveyors in the feeding zone toward the fast-moving pin-wheel La until all filaments are picked up. Since the pin-wheel La picks up filaments in sequence and at a faster speed, the filaments on pin-wheel La are also parallel to each other but are further apart. The resulting spread batt on pin-wheel La's surface is much thinner than the thickness of the original tow 1 fed onto the conveyors in the feeding zone. As the leading edge of the spread batt moving downward reaches the joining line between the pin-wheels La and Lb and the top of the conveyors Sca and Scb in the spreading zone, the filaments in the leading edge of the spread batt on pin-wheels La and Lb are caught by the finer pins on the surface of the even faster-moving conveyors Sca and Scb in the spreading zone. The conveyors Sca and Scb are different from the conveyors Fca and Fcb in the feeding zone, and each forms only a single wider conveyor. Once again, because the surface speed of the conveyors Sca and Scb in the spreading zone is faster than that of the pin-wheels La and Lb, the filaments are caught and picked up by finer pins on conveyors Sca and Scb in the spreading zone from the leading edge of the spread batt and are separated from the majority of the filaments in the spread batt which are still being held by fine pins on the pin-wheels La and Lb. In a continuous operation, the rest of the spread batt is moved downward continuously by pin-wheels La and Lb toward the faster-moving conveyors Sca and Scb in the spreading zone until all filaments are picked up by finer pins in conveyors Sca and Scb in the spreading zone. The resulting spread structure on conveyors Sca and Scb in the spreading zone is a uniform, thin batt of spread crimped continuous filaments which are parallel to each other.

The ratio of the surface speed of the conveyors Sca and Scb in the spreading zone to that in the feeding zone is defined as the spread ratio. The spread ratio determines the filament orientation angle and the layer angle, as will be described later. The surface speed of the pin-wheels La and Lb is faster than that of the conveyors Fca and Fcb in the feeding zone, but is slower than that of the conveyors Sca and Scb in the spreading zone. Since the pin-wheels La and Lb act as a separating wheel to separate filaments from the tow bundle and to transfer the resulting thinner batt to the conveyors Sca and Scb in the spreading zone for further spreading, the speed of the pin-wheels La and Lb does not change the spread ratio of the final product. However, the pin-wheel speed is adjusted based on the tow denier, crimp level, and cohesiveness of the filaments so that the filaments can be separated from the tow bundle without entanglement or damage for the uniform spreading operation.

Figure 6:
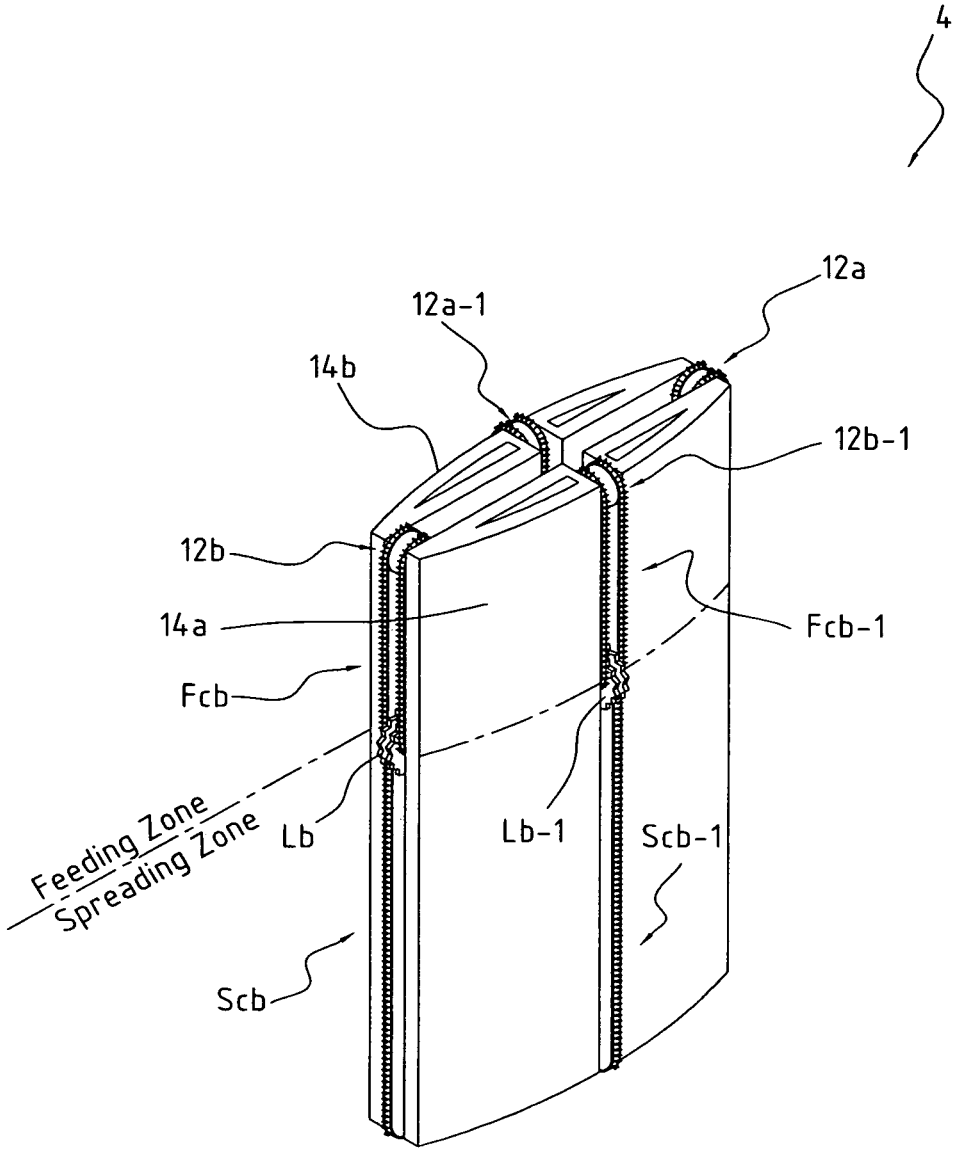
FIG. 6 front view of a modified batt-forming device used in the machine of FIG. 1.

In another aspect of the present invention, referring to FIG. 6, the batt-forming device 4 consists of four groups of conveyors 12*a*, 12*a*-1, 12*b*, and 12*b*-1 instead of the two described above; each group has two conveyors in the feeding zone and one conveyor in the spreading zone. The composition of each group of conveyors in FIG. 6 is identical to that described in FIG. 2 identified as 12*a* and 12*b*. The components of these two additional groups of conveyors 12*a*-1 and 12*b*-1 are the same as those of 12*a* and 12*b* described in FIGS. 3 to 5 with the exception that 12*a*-1 and 12*b*-1 are opposite to each other but are located 90 degrees away from 12*a* and 12*b* respectively. Identical to that of 12*a* and 12*b* shown in FIGS. 3, 12*a*-1 and 12*b*-1 each has a group of pin-wheels La-1 and Lb-1 respectively in between the feeding zone and spreading zone. With these two additional groups of conveyors and wheels, the principle operation of the batt-forming device 4 is identical to that described above, but a wider flat-tube structure can be made evenly from a wider batt-forming device 4. Because the tow of crimped continuous filaments has very good cohesion between the filaments, it is difficult to separate the individual filaments from each other if the distance between the two conveyors in which the tow 1 is engaged is large. By reducing the distance between the two adjacent conveyors as illustrated in FIG. 6, the filament cohesive force between the two supporting conveyors can be overcome by the spreading force asserted on the filaments. And as the filament cohesive force is overcome, the crimped continuous filaments can be spread evenly and smoothly, instead of sporadically, when cohesive force is overridden to form a uniform flat-tube structure. More detailed illustrations will be given below.

As the width of the batt-forming device 4 increases, further additional groups of conveyors can be installed evenly around the surfaces of the two curved plates 14*a* and 14*b*, to a total of 6, 8, 10, etc., groups of conveyors. There is no limitation to the number of groups of conveyors that can be used in the batt-forming device 4.

Referring to FIG. 1, the conveying device 6 includes two rolls 16 and an endless belt 18 mounted on and driven by the rolls 16 for delivering the flat-tube structure produced by the batt-forming device 4.

The operation of the first embodiment of the present invention is described in FIG. 1 in the following sequences.

(1) There are two separate feeding devices 2*a* and 2*b* located opposite to each other relative to the batt-forming device 4. In a continuous operation, a first portion of the tow 1 of crimped continuous filaments is delivered from the container 8*a* through feeding and spreading rolls 10*a* to conveyor 12*a* in the feeding zone. Soon after the first portion of the tow 1 is engaged with the moving conveyor 12*a*, it is transported downward at a speed slower than that of the tow 1 delivery speed from 10*a*. In an identical operation, and travelling in the same clockwise direction around the batt-forming device 4 simultaneously, a first portion of the tow 1 of crimped continuous filaments is delivered from container 8*b* through feeding and spreading rolls 10*b* to conveyor 12*b* in the feeding zone. Soon after the first portion of the tow 1 is engaged with moving conveyor 12*b*, it is transported downward at a speed slower than that of the tow 1 delivery speed from 10*b*. When the feeding device 2*a* is rotated 180 degrees clockwise in front of the batt-forming device 4, a second portion of the tow 1 of crimped continuous filaments is delivered from container 8*a* through feeding and spreading rolls 10*a* and is engaged with conveyor 12*b* in the feeding zone. In the meantime, the feeding device 2*b* is also rotated 180 degrees clockwise around the back of the batt-forming device 4, and a second portion of the tow 1 of crimped continuous filaments is delivered from container 8*b* through feeding and spreading rolls 10*b* to conveyor 12*a* in the feeding zone.

(2) The leading edge of the tow 1 of crimped continuous filaments at the bottom of the conveyors in the feeding zone is picked up by pin-wheels La and Lb respectively at faster surface speed. Therefore, filaments are being spread under tension and deposited onto conveyors in the spreading zone on both 12*a* and 12*b* having an even faster surface speed than La and Lb. As the tows 1 of crimped continuous filaments are delivered continuously from conveyors in the feeding zone of 12*a* and 12*b*, a continuous spread flat tube of continuous filaments is formed in conveyors in the spreading zone of 12*a* and 12*b*. By adjusting the ratio of the surface speed of the conveyors in the spreading zone to that in the feeding zone, which is expressed as the spread ratio, and adjusting the width of tow bands and the delivery speed of the tows 1 to the batt-forming device 4, one can change the basis weight of the flat-tube structure and the inclined angle A of the filaments relative to the CD direction as shown in FIG. 1. Ideally, a 45-degree angle will provide equal tensile strength in MD and CD directions at a ratio close to 1:1 for best balance of tensile strength. The present invention can achieve such an ideal angle of 45 degrees. To meet the specific requirements of the end product, one can adjust the angle A between approximately 10 and 70 degrees to provide the desired tensile strength, stretchability, and loft.

(3) In a continuous rotating motion, the feeding device 2*a* is moving to the back of the batt-forming device 4 in FIG. 1 or facing the curved plate 14*b* in FIG. 2, while the feeding device 2*b* is moving to the front of the batt-forming device 4 in FIG. 1 or facing the curved plate 14*a* in FIG. 2. A third portion of the tow 1 of crimped continuous filaments is delivered from container 8*a* through feeding and spreading rolls 10*a* and is engaged with moving conveyor 12*a* in the feeding zone. Simultaneously, in an identical operation, a third portion of the tow 1 of crimped continuous filaments is delivered from container 8*b* through feeding and spreading rolls 10*b* and is engaged with moving conveyor 12*b* in the feeding zone. This process is repeated many times exactly as described in sequences (1), (2), and (3) above; therefore, a continuous flat-tube structure of spread crimped continuous filaments is formed in the batt-forming device 4 and subsequently delivered to conveyor device 6.

Figure 7:
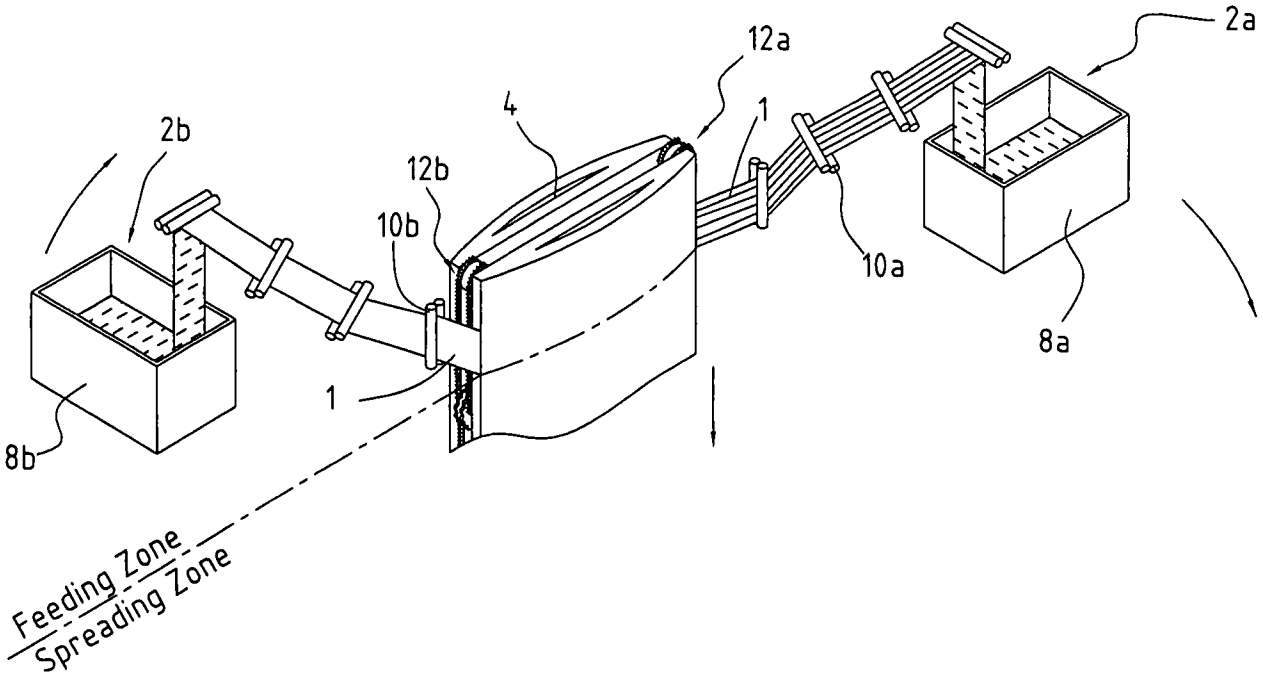
FIG. 7 drawing of spreading step 1 of each tow of crimped continuous filaments at 0 second according to the first embodiment of the present invention.
Figure 8:
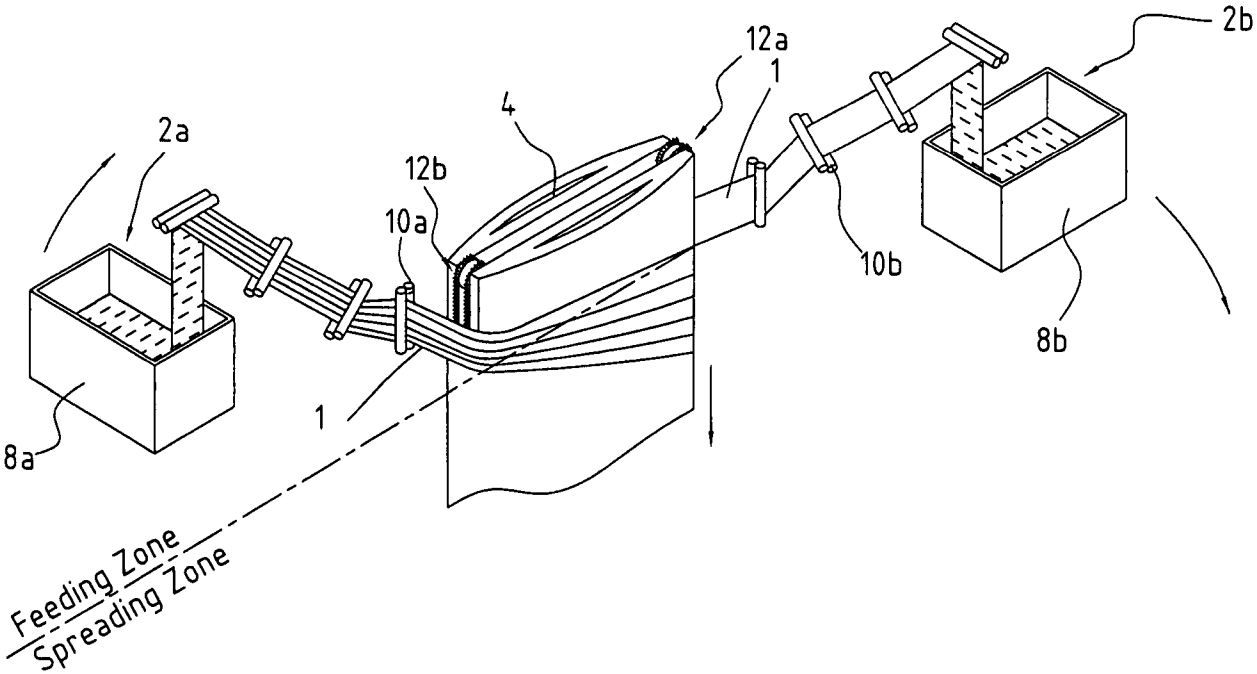
FIG. 8 drawing of spreading step 2 of each tow of crimped continuous filaments at 8 seconds according to the first embodiment of the present invention.
Figure 9:
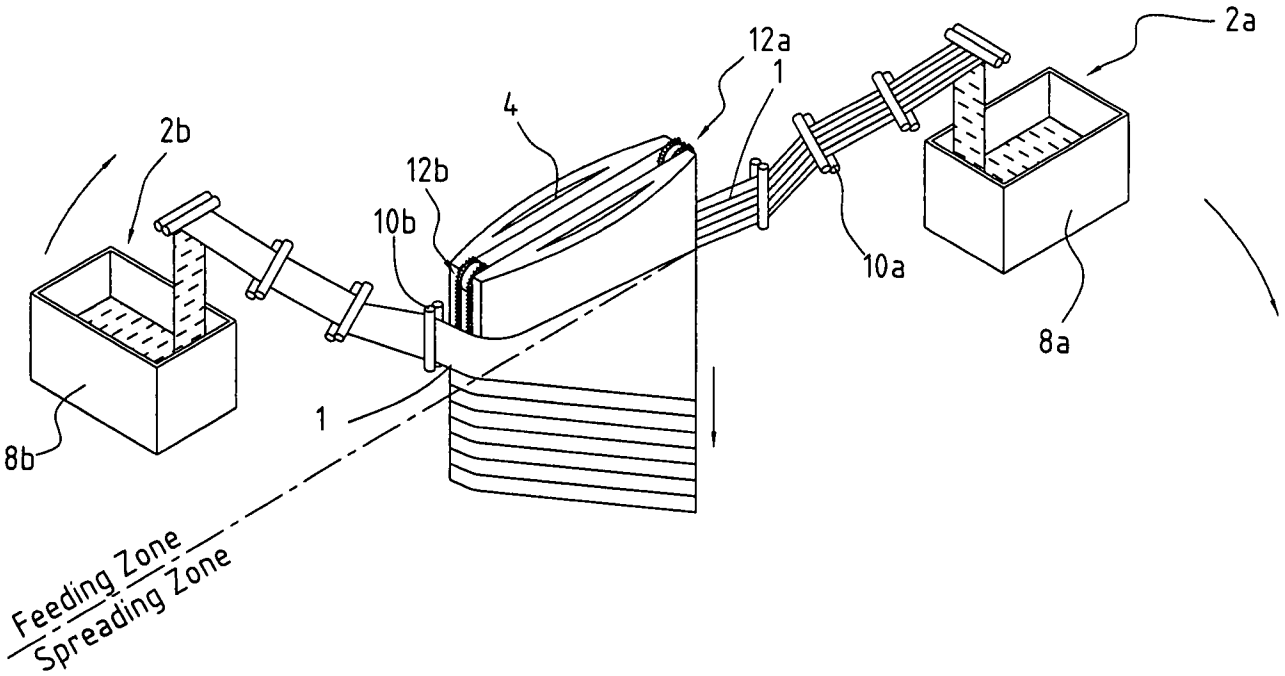
FIG. 9 drawing of spreading step 3 of each tow of crimped continuous filaments at 16 seconds according to the first embodiment of the present invention.
Figure 10:
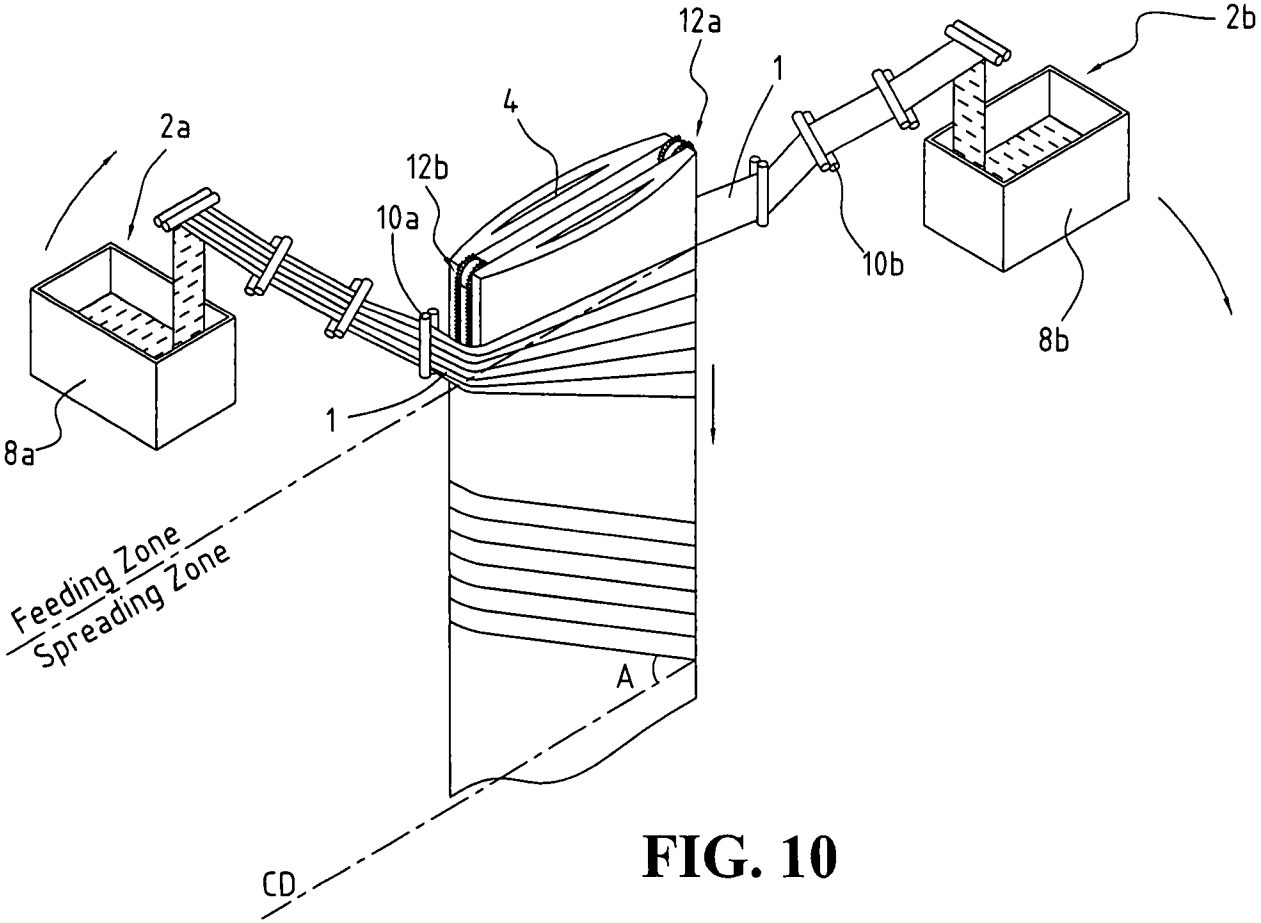
FIG. 10 drawing of spreading step 4 of each tow of crimped continuous filaments at 24 seconds according to the first embodiment of the present invention.

Referring to FIGS. 7 to 10 as the illustrations of one aspect of the present invention, two 0.25-meter-wide tows of crimped continuous filaments are delivered from 8*a* and 8*b* respectively, wrapping around a 2-meter-wide batt-forming device 4 at a speed of 0.25 meter per second, which is identical to that of the conveyor speed in the spreading zone. The conveyor speed in the feeding zone is ⅛ of that of the conveyors in the spreading zone, or 0.03125 meter per second, resulting in a spread ratio of 8. As shown in FIGS. 7 to 10, in every eight seconds, tows 1 delivered from containers 8*a* and 8*b* have traveled the distance of 2 meters between conveyors 12*a* and 12*b*, with FIG. 7 showing the first 0 second of traveling, FIG. 8 showing the $8^{th}$ second of traveling, FIG. 9 showing the $16^{th}$ second of traveling, and FIG. 10 showing the $24^{th}$ second of traveling. During this period, the first portions of the engaged tows 1 have been spread from 0.25 meter to 2 meters in the spreading zone. Because 8*a* and 8*b* are traveling in the same direction but are 180 degrees apart, each spread tow pattern is also the opposite and mirror image of the other. However, when the two spread tow patterns are super-imposed on each other as in the continuous operation involving two separate feeding devices in the present invention, a continuous flat tube of spread crimped continuous filaments, as shown in FIG. 1, is formed continuously.

Figure 11:
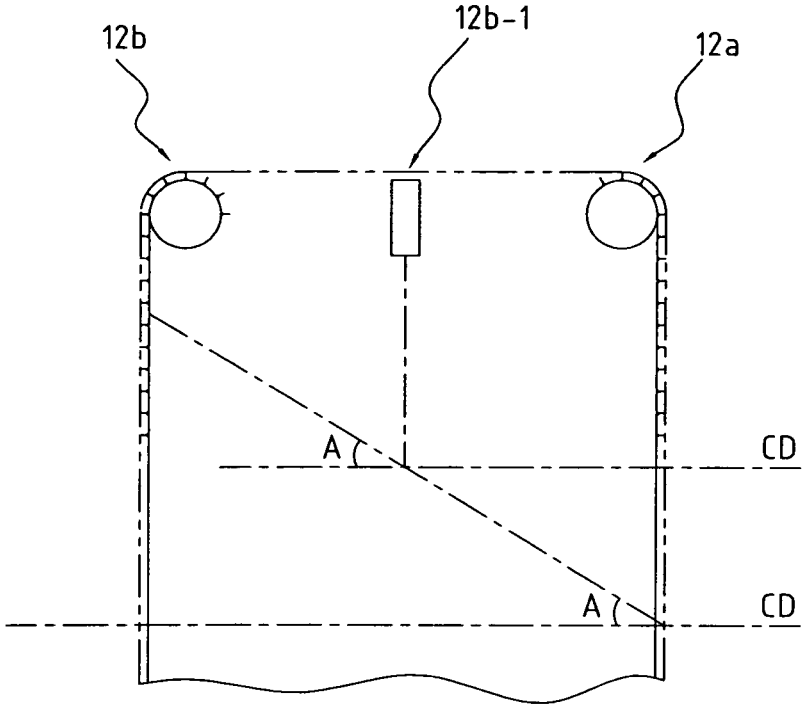
FIG. 11 graphic demonstration of no filament orientation angle change with either two or four groups of conveyors in the batt-forming device.

Referring to FIG. 6 as another illustration of other aspects of the present invention using four groups of conveyors instead of two as described above, two 0.25-meter-wide tows 1 of crimped continuous filaments are delivered from 8*a* and 8*b* respectively, wrapping around a 2-meter-wide batt-forming device 4 at a speed of 0.25 meter per second, which is identical to that of the conveyor speed in the spreading zone. Since all four pin conveyors in the feeding zone are moving at the same speed and all four pin conveyors in the spreading zone are moving at the same but faster speed, the operation is the same as in the above illustration. For example, after 8 seconds, the first portion of tow 1 engaged with 12*a* in FIGS. 7 to 10 having a 2-meter-wide batt-forming device 4 has been spread from 0.25 meter to 2 meters in the spreading zone, forming a 45 degree filament orientation angle between 12*a* and 12*b*. But adding two more groups of pin conveyors 12*a*-1 and 12*b*-1 as in FIG. 6, after 8 seconds, the engaged tow at 12*a* also has been spread from 0.25 meter to 2 meters in the spreading zone, and the engaged tow at 12*b*-1 is only spread from 0.25 meter to 1 meter in the spreading zone because tow 1 engaged with 12*b*-1 is 4 seconds late after engaging with 12*a*. Therefore, the filament orientation is still maintaining 45 degrees, the same as the above, as is shown in FIG. 11. Because of this time delay to reach 12*b*-1, the spread tow formation is the same whether 12*b*-1 is installed in the batt-forming device 4 or not. The same situation can be applied with 12*a*-1 relative to the spread tow formation. The advantage of the additional two groups of conveyors 12*a*-1 and 12*b*-1 as described previously is reducing the distance between engaging conveyors to override the cohesive force exhibited in the tow 1 of crimped continuous filaments so that uniform and smooth spreading can be achieved to form a uniform flat-tube structure. With a much wider batt-forming device to make a wider flat-tube structure, additional groups of conveyors in the feeding zone and the spreading zone are beneficial to overcome the cohesive force of the crimped continuous filaments for a successful spreading operation.

Figure 12:
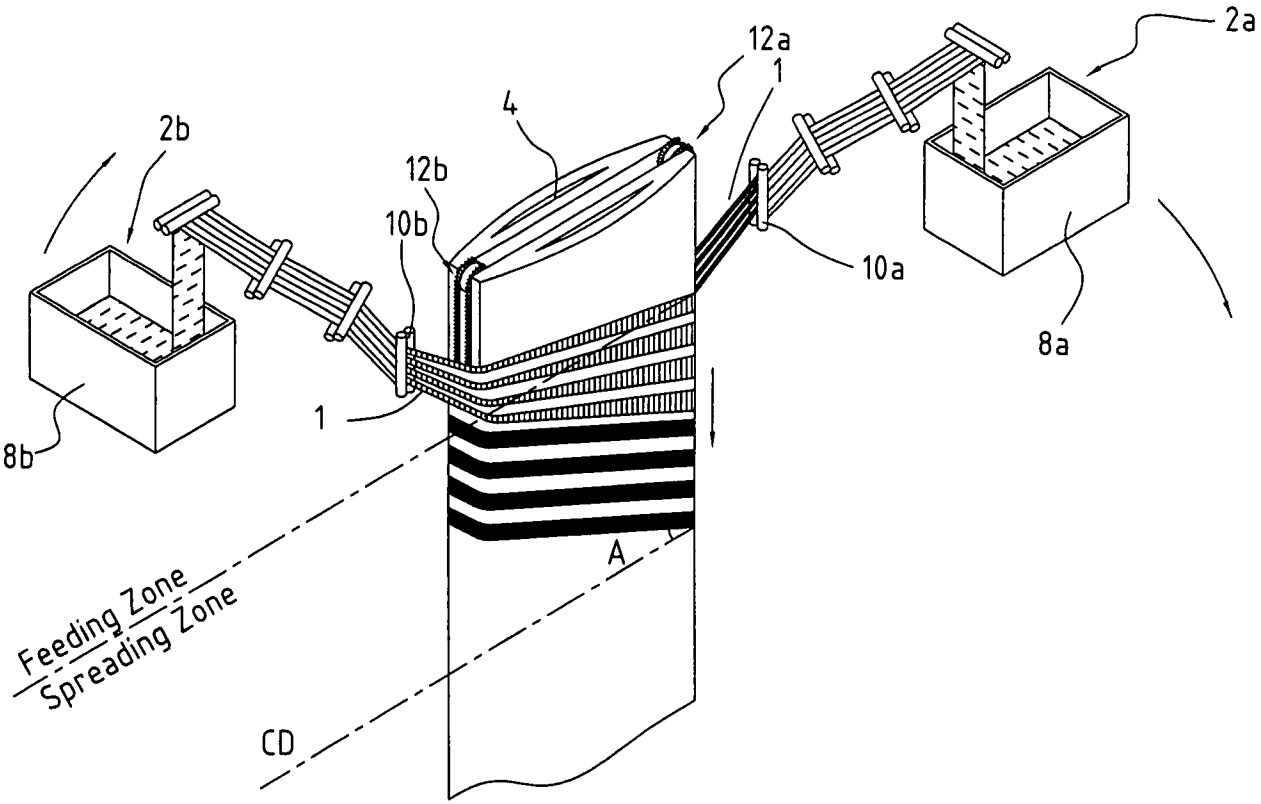
FIG. 12 perspective view of a machine for producing a flat-tube structure from two tows of crimped continuous filaments which are separated into many small bundles of filaments according to the first embodiment of the present invention.

In yet another aspect of the present invention, referring to FIG. 12, the two separate tows 1 being fed from containers 8*a* and 8*b* respectively have a different configuration compared to that shown in FIG. 1. The tows 1 shown in FIG. 1 and described in this embodiment are very uniform tow bands which can be characterized as having essentially the same thickness, density, and continuity across the width of the tow band. The resulting flat-tube structure is a homogeneous, uniform structure in appearance and in properties, having balanced tensile strength in all directions and providing structural stability and stretch recovery properties. However, the tow bands shown in FIG. 12 are separated into many small bundles of filaments by an additional special device, such as separating guide pins or guide rolls in 10*a* and 10*b* respectively, before feeding them to the batt-forming device 4. The resulting bundles of filaments within the tow band are separated from each other with a definite gap between them, with the distance depending on the design of the separating device. These heterogeneous tow bands consisting of many small bundles of filaments and space in between them can form a heterogeneous flat-tube structure of crimped continuous filaments using the same machine and process of the present invention. The resulting heterogeneous flat-tube structure has essentially the same structure and characteristics, mainly having a balance of tensile strength in all directions and providing structural stability and stretch recovery properties with some exceptions. There are many empty spaces without filaments formed along each layer of the ban and many holes created within the structure, as shown in FIG. 12. The resulting flat-tube structure has the appearance of a loosely woven structure in the form of mesh wire or fishing net, with many holes between filament cross-over points. This structure provides unique attributes, such as high air permeability through open holes for good breathability with low density, resiliency, and good support, which can be used as components to satisfy important requirements in mattress and furniture applications. This further demonstrates the flexibility and versatility of the present invention. This aspect of the present invention can be used singularly or in combination with other aspects of the present invention as described in all embodiments of the present invention.

Figure 13:
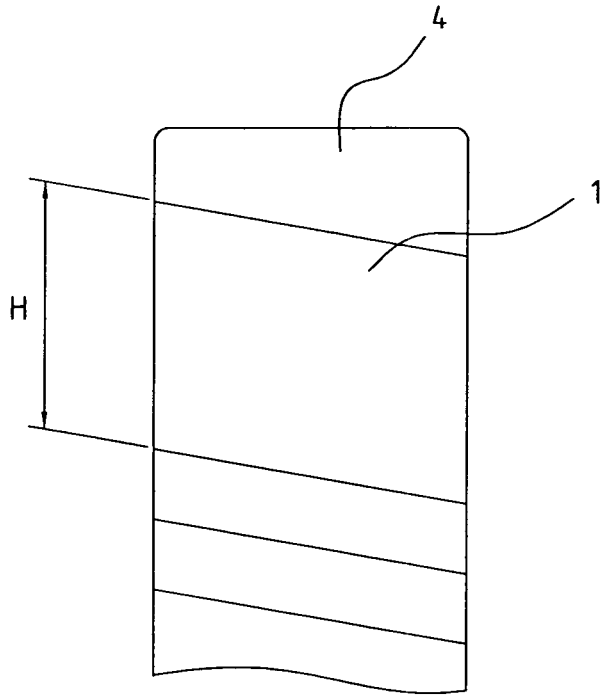
FIG. 13 illustration of using a wide tow band to make flat-tube structure with minimal or no cross-lapped marks with the present invention.
Figure 14:
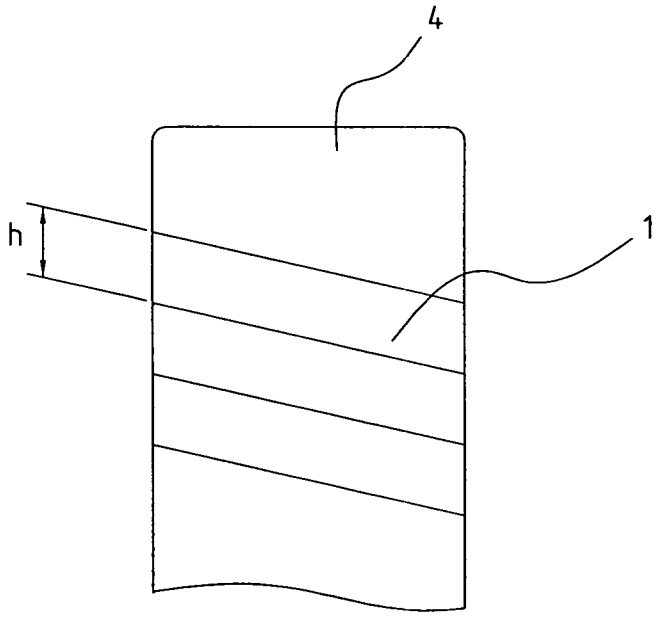
FIG. 14 illustration of usual tow band width to make flat-tube structure with the present invention.

In yet another aspect of the present invention, referring to FIGS. 13 and 14, there are no limitations on the denier, homogeneity, and width of the tow bands to be used with the present invention. Contrary to the aspect described above as illustrated in FIG. 12, the present invention can also provide a very uniform flat-tube structure with very little or no cross-lapped marks as normally appear in a conventional cross-lapped structure described in prior art. Instead of using the usual thick and narrow tow band, a thin but wider tow band can be used to achieve a much more uniform flat-tube structure with essentially no cross-lapped marks between layers. For example, by using a tow band width of 75 cm (H) (as shown in FIG. 13) instead of the usual 25 cm (h) (as shown in FIG. 14) as described above for the feeding tow for the batt-forming device 4, one can minimize or eliminate the cross-lapped marks on the flat-tube structure. Because the feeding tow as shown in FIG. 13 is three times wider, it will overlap three times in the feeding zone of the batt-forming device before reaching the spreading zone; hence, the marks on the over-lapped layers in the feeding zone are virtually eliminated compared to the obvious heavy marks appearing on the two adjacent thick and narrow tow bands. The resulting flat-tube structure from this wide tow band has essentially no cross-lapped marks. This further demonstrates the flexibility and versatility of the present invention.

The wrapped angle between the two cross-lapped layers is ideally 90 degrees for equal strength in MD and CD directions. Other cross-lapped layer angles can be achieved by this invention by adjusting the traveling speed of feeding devices 2*a* and 2*b* wrapping around the batt-forming device 4 and the spread ratio of the conveyor speeds between spreading zone and feeding zone. To meet the specific requirements of the end use, one can achieve the cross-lapped layer angles between about 20 and 140 degrees for specific desired tensile strength, stretchability, and loft. It is desirable that the spread tow leaves the batt-forming device 4 for the conveying device 6 when the section of the tow 1 between the first and second portions is at an appropriate angle from the section of the tow 1 between the second and third portions. The angle will determine the tensile strength ratio between MD and CD directions of the flat-tube structure.

Figure 15:
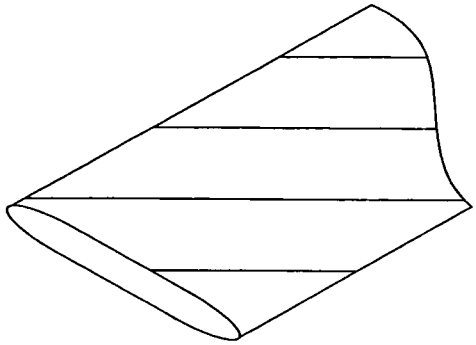
FIG. 15 illustration of a flat-tube structure made by the present invention.
Figure 16:
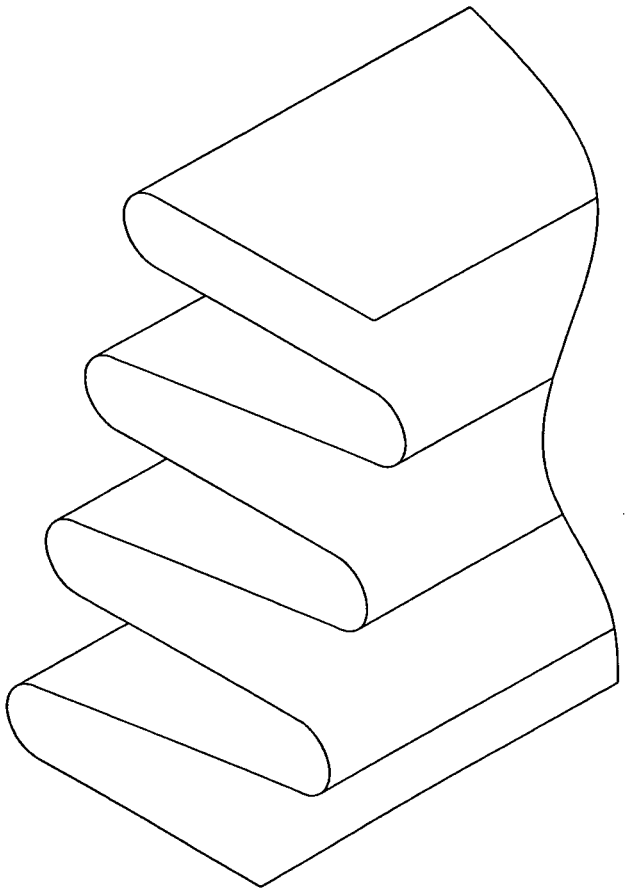
FIG. 16 illustration of a cross-lapped structure made by the conventional process.

There is a very important distinction between the spread flat-tube structure of the present invention compared to conventional cross-lapping batting by the process described in the prior art mentioned earlier. The flat tube of the present invention is an endless tube structure with very good uniformity throughout the entire structure, including edges and center, with dimensional stability, good stretchability, and high loft as shown in FIG. 15, whereas the batt created by a conventional cross-lapping method is a folding-layer structure which has the appearance of fish scales which can be peeled off layer by layer as shown in FIG. 16, with deficiencies of uniformity, poor cohesion between layers, poor balance of MD and CD tensile strength, and inadequate dimensional stability.

As shown in FIG. 1, the feeding devices 2*a* and 2*b* are located at identical height in the feeding zone relative to the batt-forming device 4, and they are separated by 180 degrees and rotate around the batt-forming device 4 in a clockwise direction. However, the feeding devices 2*a* and 2*b* can be at different heights in the feeding zone relative to the batt-forming device 4, be different degrees apart, and rotate in different directions around the batt-forming device 4. As long as both feeding devices are located above the dividing line between the feeding zone and spreading zone, a flat-tube structure from spread tow 1 of crimped continuous filaments can be produced by the present invention.

Figure 17:
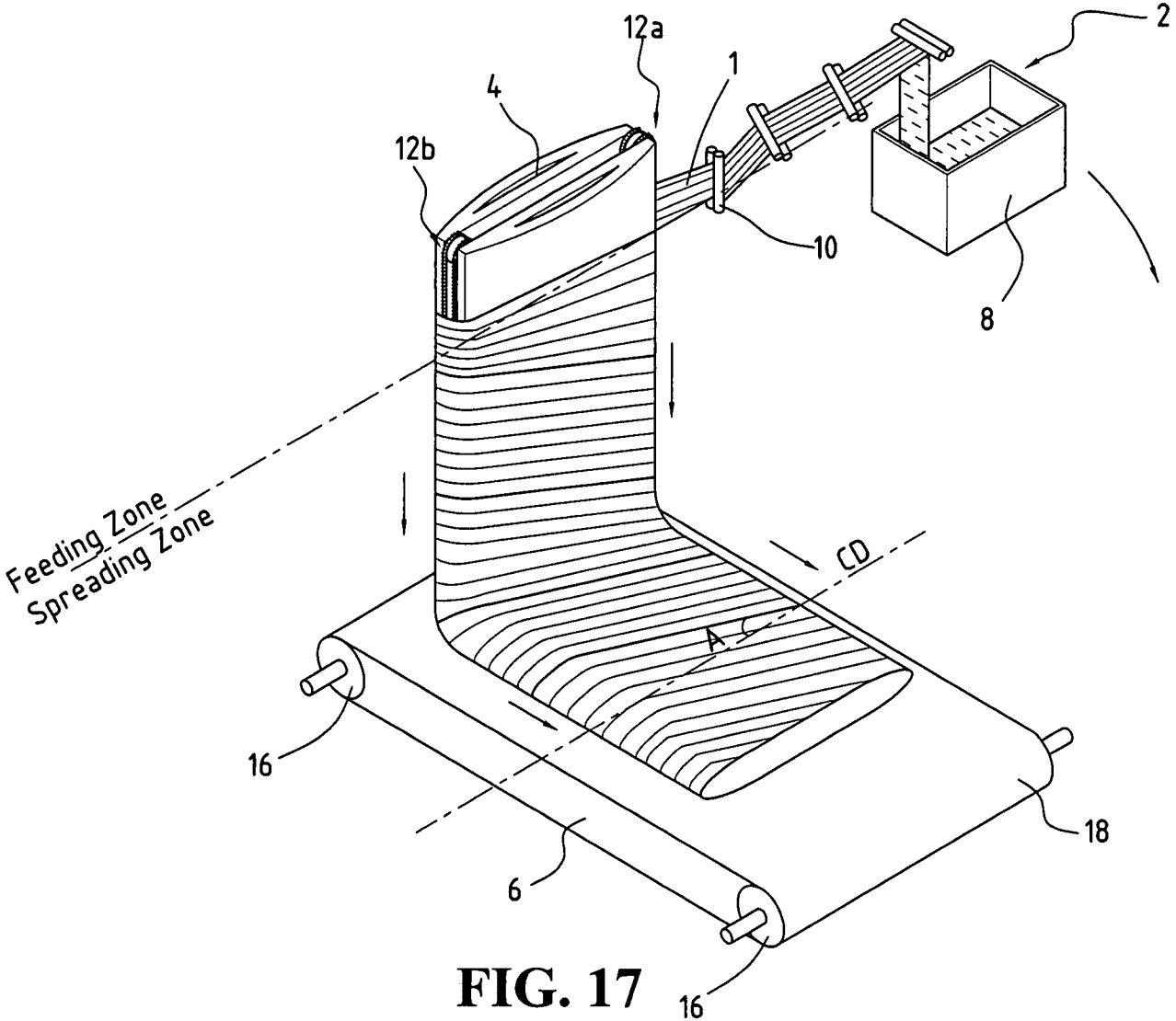
FIG. 17 perspective view of a machine for producing a flat tube from a tow of crimped continuous filaments according to the second embodiment of the present invention.

Referring to FIG. 17, according to a second embodiment of the present invention, a machine and process for producing a flat-tube structure of crimped continuous filaments includes a single feeding device 2; a spreading, extending, and wrapping device 4, which will be called the batt-forming device 4; and a conveying device 6. A tow 1 of crimped continuous filaments is fed from the feeding device 2 to the batt-forming device 4, where the tow 1 is spread, extended, and wrapped. From the batt-forming device 4, a flat-tube structure of crimped continuous filaments is delivered to the conveying device 6.

The feeding device 2 consists of a container 8 in which the tow 1 is stored and a series of rolls 10 for spreading and feeding the tow 1 from the container 8 to the batt-forming device 4. Although not shown, a mechanism is used to carry and drive the feeding device 2 wrapping around the batt-forming device 4 continuously, either in a clockwise or counterclockwise direction for producing a continuous flat-tube structure of crimped continuous filaments.

The batt-forming device consists of two groups of pin-covered conveyors 12*a* and 12*b* and two curved plates as shown in FIGS. 2 to 4. The description of the composition and operation of the batt-forming device 4 is identical to that in the first embodiment of the present invention and is shown in FIGS. 2 to 4.

The operation of the second embodiment of the present invention is similar to that of the first embodiment of the present invention except a single container is needed as described as container 8*a* in the first embodiment of the present invention. The other exception is that the conveyor speed of 12*a* and 12*b* in the feeding zone is even slower than that of the tow delivery speed from the series of rolls 10, for example, 1/16 instead of 1/8, as in the case of the first embodiment. Because of the speed difference, a single feeding device can cover the total area needed for two feeding devices as shown in FIGS. 7 to 10. In order to keep a spread ratio of 8, the conveyor speed in the spreading zone is eight times faster than that of the conveyor speed in the feeding zone. As result, unlike the illustration in FIGS. 7 to 10, the tow 1 speed from container 8 wrapping around the batt-forming device 4 is actually twice (2×) that of the conveyor speed in the spreading zone. In other words, in eight seconds, container 8 has made one complete circle (360 degrees) around the batt-forming device 4 and engaged a third portion of the tow 1 with 12*a* instead of just traveling half a circle (or 180 degrees) or engaging a second portion of tow 1 with 12*b*. This illustrates the flexibility and versatility of this machine and process to make flat-tube structures with various basis weights, filaments and cross-lapped angles, and productivity by adjusting various combinations of the tow 1 denier, the feeding speed from container 8, and the spread ratio of the batt-forming device 4.

Figure 18:
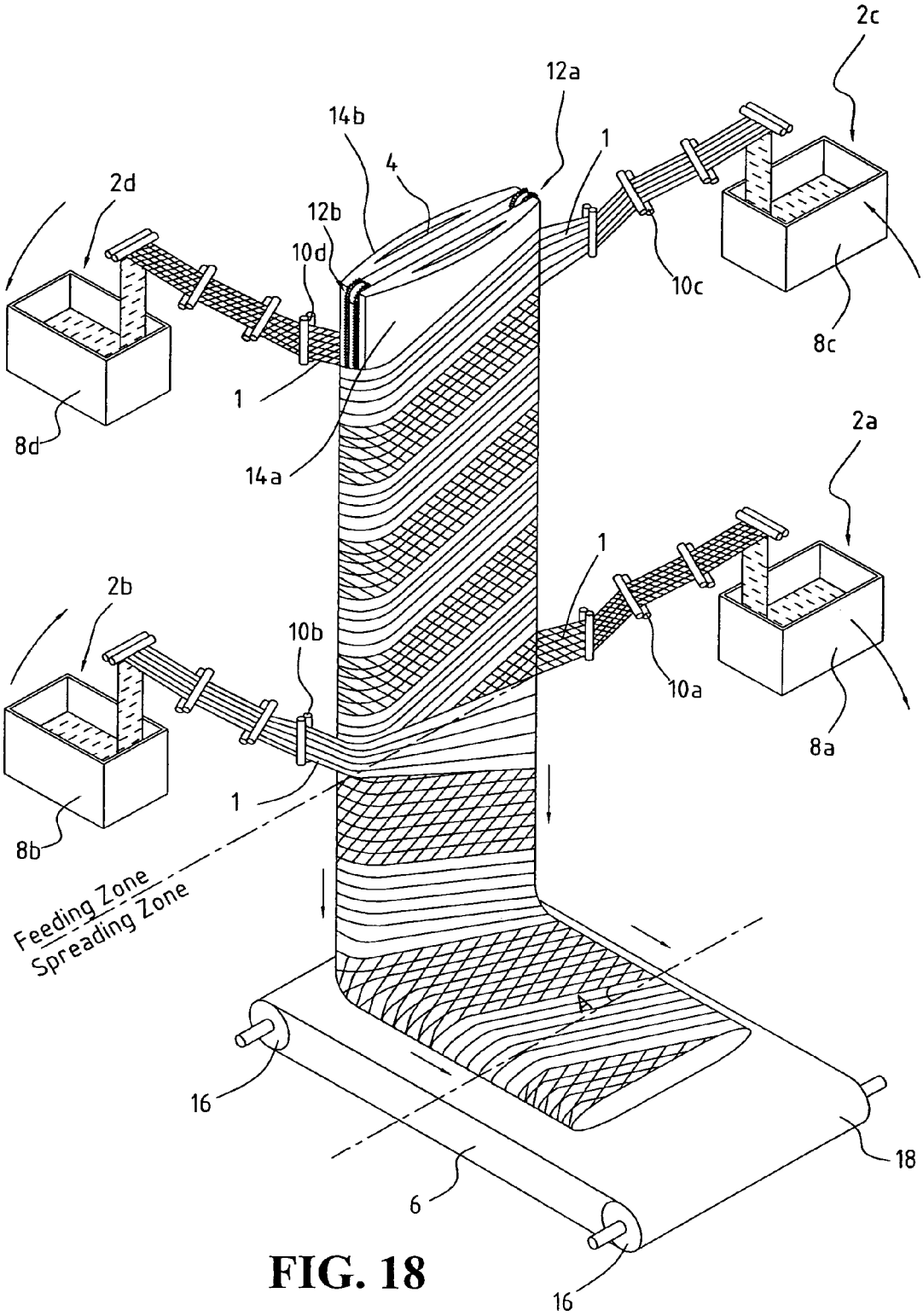
FIG. 18 perspective view of a machine for producing a flat-tube structure from four tows of crimped continuous filaments according to the third embodiment of the present invention.

Referring to FIG. 18, according to a third embodiment of the present invention, a machine and process for producing a flat-tube structure of crimped continuous filaments includes four separate feeding devices 2*a* and 2*b* located at the same height relative to the batt-forming device 4, both rotating in the same direction as shown in FIGS. 1, and 2*c* and 2*d* located at the same height but higher than that of 2*a* and 2*b* relative to the batt-forming device 4, both rotating in the same direction, which could be the same as or different from the direction of 2*a* and 2*b*.

As shown in FIGS. 18, 2*a* and 2*b* rotate clockwise around the batt-forming device 4 and both are located just above the dividing line between the feeding zone and the spreading zone. The other two feeding devices 2*c* and 2*d* rotate counterclockwise around the batt-forming device 4 and are located higher above both 2*a* and 2*b* and also further away from the dividing line between the feeding zone and the spreading zone.

The procedure of engaging and spreading the tows 1 of crimped continuous filaments from containers 8*a* and 8*b* is identical to that of the three sequences (1), (2), and (3) described previously in the first embodiment of the present invention shown in FIG. 1. The other two feeding devices 2*c* and 2*d* are located opposite to each other but above 2*a* and 2*b* relative to the batt-forming device 4. In a continuous operation, a first portion of the tow 1 of crimped continuous filaments is delivered from the container 8*c* through feeding and spreading rolls 10*c* to conveyor 12*a* in the feeding zone. Soon after the first portion of the tow 1 is engaged with the moving conveyor in the feeding zone 12*a*, the engaged portion of the tow 1 is being transported downward at a slower speed than that of the tow 1 delivery speed from 10*c*. Simultaneously in an identical operation, and traveling in the same counterclockwise direction around the batt-forming device 4, a first portion of the tow 1 of crimped continuous filaments is delivered from container 8*d* through feeding and spreading rolls 10*d* to conveyor 12*b* in the feeding zone. Soon after the first portion of the tow 1 is engaged with the moving conveyor 12*b* in the feeding zone, the engaged portion of the tow 1 is being transported downward in similar fashion as the engaged tow 1 from container 8*c*. When feeding device 2*c* is rotated 180 degrees counterclockwise around the back of the batt-forming device 4, or facing the curved plate 14*b* in FIG. 2, a second portion of the tow 1 of crimped continuous filaments is delivered from container 8*c* through feeding and spreading rolls 10*c* and is engaged with conveyor 12*b* in the feeding zone. In the meantime, the feeding device 2*d* is also rotated 180 degrees counterclockwise around the front of the batt-forming device 4 or facing the curved plate 14*a* in FIG. 2, and a second portion of the tow 1 of crimped continuous filaments is delivered from container 8*d* through feeding and spreading rolls 10*d* and engaged with conveyor 12*a* in the feeding zone. The process is repeated with the third and fourth portions of tows 1 of crimped continuous filaments from feeding devices 2*c* and 2*d* and the process is repeated continuously.

The engaged tows 1 in the feeding zone delivered from containers 8*c* and 8*d* are transferred along the downward moving conveyors 12*a* and 12*b* in the feeding zone for a distance until they reach close to the dividing line of the feeding zone and spreading zone and are laid over and combined with tows 1 from feeding devices 2*a* and 2*b*.

The leading edges of the combined tows 1 of crimped continuous filaments at the bottom of the conveyors in the feeding zone are picked up by pin-wheels La and Lb, as shown in FIGS. 3 to 5, at faster surface speed. Therefore, filaments are being spread under tension and deposited onto conveyors 12*a* and 12*b* in the spreading zone, with both having faster surface speed than that of La and Lb. As the tows 1 of crimped continuous filaments are delivered continuously from conveyors 12*a* and 12*b* in the feeding zone, a continuous flat-tube of spread crimped continuous filaments is formed in conveyors in the spreading zone of 12*a* and 12*b* of the batt-forming device 4, and subsequently delivered to conveying device 6. This part of the spreading, extending, and wrapping process is identical to that described in the first embodiment of the present invention.

The locations of the feeding devices 2*a* and 2*b* can be at the same or different heights above the dividing line between the feeding zone and the spreading zone. They may rotate in the same or different direction either clockwise or counterclockwise around the batt-forming device 4. The locations of feeding devices 2*c* and 2*d* are higher than those of 2*a* and 2*b* but each can be at the same or different heights and rotate in the same or different directions around the batt-forming device 4. Once again, the ratio of surface speed of the conveyors in the spreading zone to that in the feeding zone is expressed as the spread ratio. The spread ratio determines the filament orientation angle vs. the CD direction and the cross-lapped angle between layers of the flat-tube structure.

Figure 19:
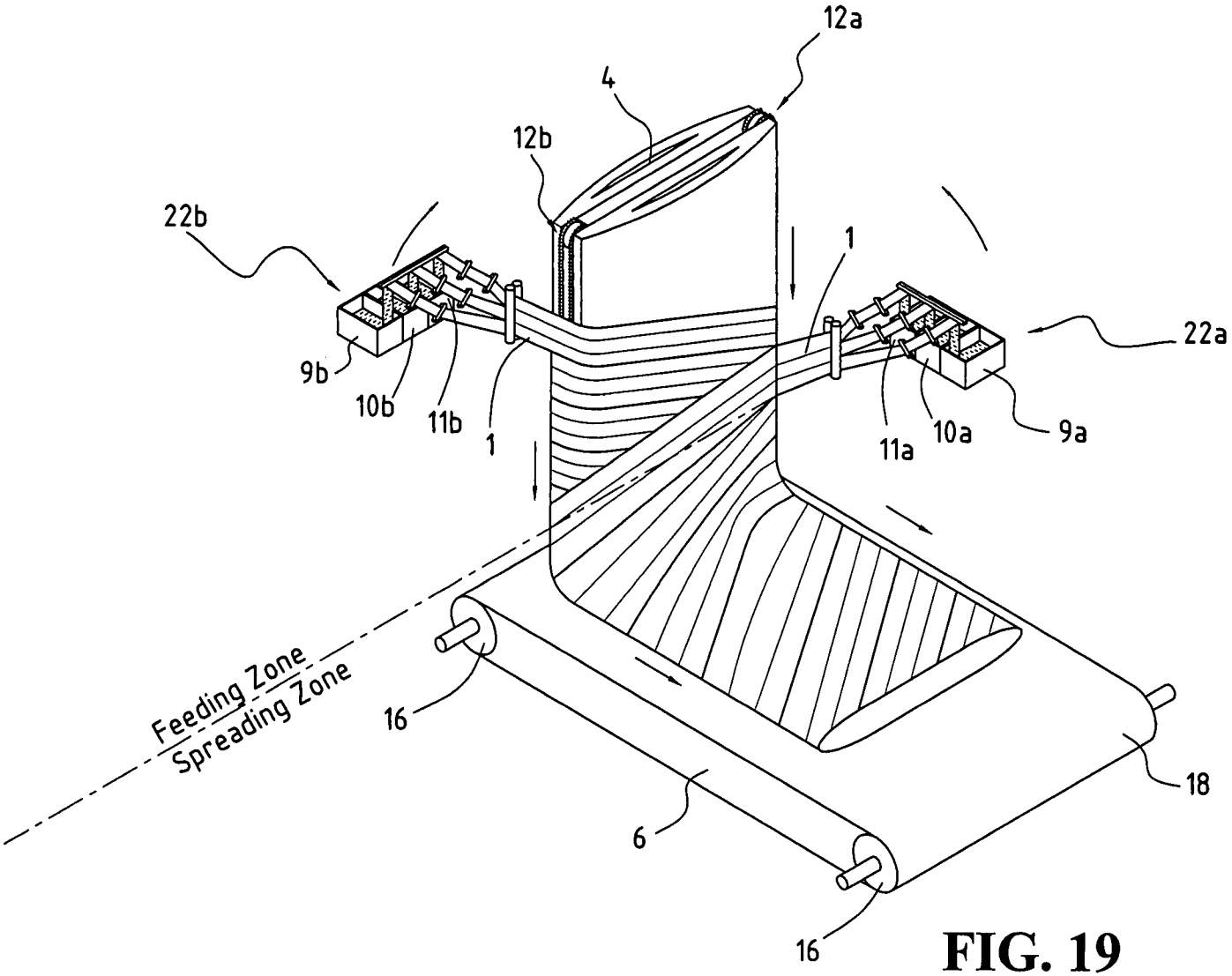
FIG. 19 perspective view of a machine for producing a flat-tube structure from multiple tows of crimped continuous filaments according to the fourth embodiment of the present invention.

Referring to FIG. 19, according to a fourth embodiment of the present invention, a machine and process for producing a flat-tube structure of spread crimped continuous filaments includes two separate feeding devices 22*a* and 22*b*. Each consists of multiple containers 9*a*, 10*a*, and 11*a* in 22*a*, and 9*b*, 10*b*, and 11*b* in 22*b*; a spreading, extending and wrapping device 4, now called the batt-forming device 4 comprising a feeding zone and spreading zone, with composition identical to that in FIGS. 2 to 4, and a conveying device 6. The number of containers in feeding devices 22*a* and 22*b* varies from 2 to 100, depending on the denier and the width of the tow 1 in each container. A tow 1 of crimped continuous filaments is fed from each of the containers in feeding devices 22*a* and 22*b* to the batt-forming device 4 where the tow 1 is spread, extended and wrapped into a flat-tube structure and is finally delivered to conveying device 6. The batt-forming device 4 and conveying device 6 in FIG. 19 are identical to that in FIGS. 1 and 18. The mechanism of spreading, extending and wrapping according to this embodiment of the present invention is the same as described in FIG. 1, except multiple numbers of tows 1 are fed to the batt-forming device 4 from each of the feeding devices 22*a* and 22*b*.

More than two additional feeding devices as described as 22*a* and 22*b* in FIG. 18 can be used with the present invention to make various basis weights and compositions of the flat-tube structure.

Figure 20:
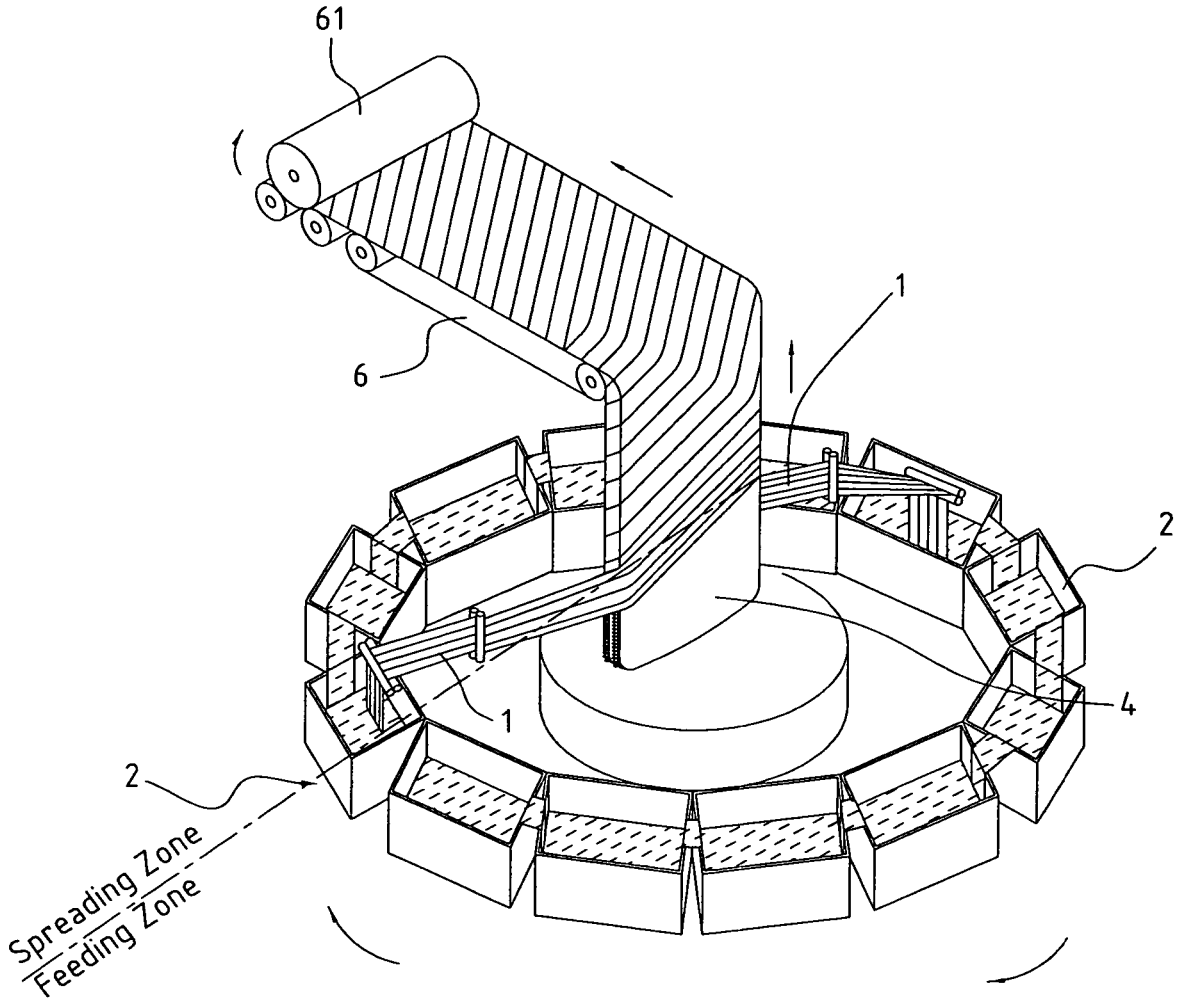
FIG. 20 perspective view of a machine for producing a flat-tube structure from tows of crimped continuous filaments with batt-forming device moving upward instead of downward as shown in FIGS. 1, 17, 18 and 19.

To illustrate the flexibility and versatility of the present invention, referring to FIG. 20, a feeding mechanism can consist of a track circle around the batt-forming device 4, which is fed by feeding devices 2 moving around the track at a pre-determined speed. If desired, for convenience, as shown in FIG. 20, the conveyors in the batt-forming device 4 can move upward instead of downward as shown in FIG. 1, so that the conveyors in the feeding zone are at the lower level and the conveyors in the spreading zone are at the upper level. As a result, the conveying device 6 and windup rolls 61 are also located at the higher level of the machine. The composition of the batt-forming device 4 is identical to that in FIG. 1 with the same components as in FIGS. 2 to 4, except the conveyors in the feeding zone and the spreading zone are moving upward instead of downward. The principle of spreading, extending, and wrapping is exactly the same as that of the first embodiment of the present invention.

Figure 21:
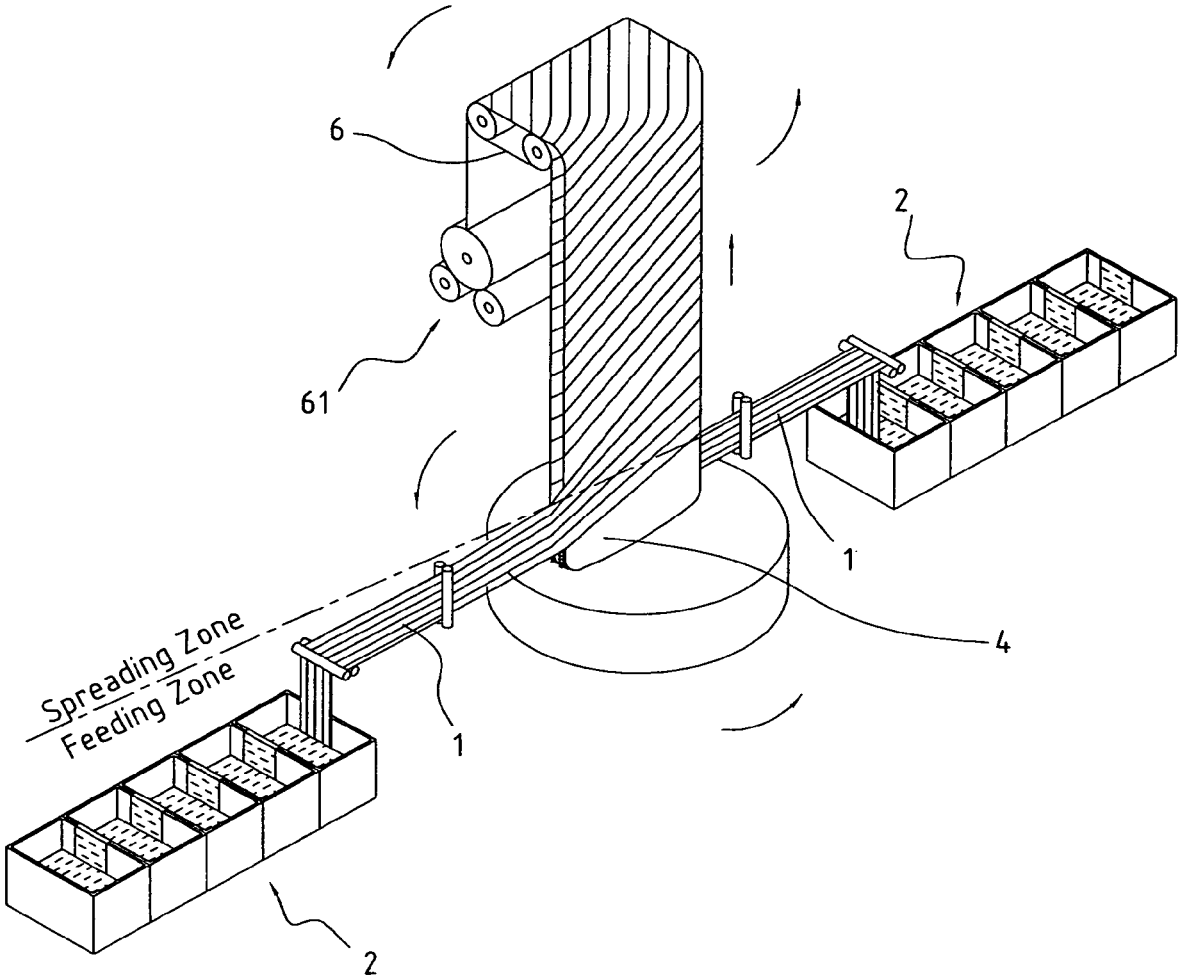
FIG. 21 perspective view of a machine for producing a flat-tube structure from tows of crimped continuous filaments according to the fifth embodiment of the present invention.

Referring to FIG. 21, according to a fifth embodiment of the present invention, a commercially feasible and economically viable machine and process for producing a flat-tube structure of spread tow 1 of crimped continuous filaments includes a system composed of a batt-forming device 4, a conveying device 6, and a windup device 61, all connected to a rotating platform, and two or more stationary feeding devices 2. The composition of the batt-forming device 4 is identical to that in FIG. 1, with the same components as in FIGS. 2 to 4, except the conveyors in the feeding zone and spreading zone are moving upward instead of moving downward. The principle of spreading, extending, and wrapping is exactly the same as that of the first embodiment of the present invention. As the platform rotates in either a clockwise or counterclockwise direction at a pre-determined speed, tows 1 of crimped continuous filaments are fed from stationary feeding devices 2 wrapping around the conveyors in the feeding zone at the lower level of the rotating batt-forming device 4. These engaged tows 1 are then spread in the spreading zone on the upper level and subsequently delivered to conveying device 6, followed by windup device 61. The ratio of the surface speed of the conveyors in the spread zone to that in the feeding zone is expressed as the spread ratio. Once again, the basis weight of the flat-tube structure, the angle between the filaments and the CD direction of the flat tube, and the cross-lapped angle between layers are determined by the combinations of the feeding speed of the tows, the width of the tow 1, and the spread ratio. The feeding devices 2 can be at the same level as shown in FIG. 21, or in different platforms with various heights so that each tow 1 can be fed in different heights in the feeding zone of the batt-forming device 4. The number of containers in each feeding device 2 can vary from 2 to 100, depending on the denier and the width of the tow 1 in each container.

The rotating batt-forming device in FIG. 21 can be driven by some other means other than the rotating platform as shown. The batt-forming device 4 also can be arranged in the same configuration as in FIG. 1, where the conveyors in both the feeding zone and the spreading zone are moving downward, so that tows can be fed from the stationary feeding devices 2 to the feeding zone and transferred to the spreading zone one floor below. Subsequently, the spread flat tube is delivered to the conveying device 6 and windup unit 61 at the lower floor.

DEFINITION OF TERMS

A. Stretch recovery: A batting or nonwoven fabric is stretched to 150% to length L2 from the original length, Lo, and the stress is released. The recovery length, L1, is measured after 10 minutes' relaxation.

The percent recovery, R, is calculated as:

$$R=\{1-(L1-Lo)/(L2-Lo)\}\times 100$$

When L1=L2, there is 0% recovery.

When L1=Lo, there is 100% recovery.

The measurement is determined in both MD and CD directions of the sample. The higher the percent recovery. the better the stretchability.

B. Loft: Loft is defined as thickness per unit weight. For example, inch per oz. per square yard, or mm. per gram per square meter.

C. Dimensional stability: The ability to maintain the size, i.e., width, length and height, during processing and in use.

D. Tensile strength: The ability to withstand the stress applied on a sample without breaking.

EXAMPLES

Example 1

Referring to FIG. 1, a tow 1 of crimped continuous filaments with 100,000 filaments and total denier of 600,000 having a width of 0.125 meter is fed from container 8*a* through a series of feeding and spreading rolls 10*a* which widen it to a 0.25-meter tow band, then wrap it clockwise around a 2-meter-wide batt-forming device 4 and engage it with conveyor 2*a* in the feeding zone at a speed equal to 0.25 meter per second. The feeding zone conveyor surface speed is about 0.03125 meter per second, which is about ⅛ of the feeding speed of the tow 1 wrapping around the batt-forming device 4. The tow 1 is spread by conveyor 12*a* in the spreading zone at a surface speed of 0.25 meter per second, resulting in a spread ratio of 8, which is equal to the conveyor surface speed in the spreading zone divided by the conveyor surface speed in the feeding zone. By the time the tow band travels 2 meters to reach and engage with conveyor 12*b* in the feeding zone, the first portion of the tow 1 at 12*a* has already been spread from 0.25 meters to 2 meters wide to form a batt with a 45-degree angle relative to the CD direction. Therefore, the original crimp in the continuous filaments is being extended, and the individual filaments in the tow 1 are spread and separated from each other. The first portion of the original 0.25-meter-wide tow band becomes a 2-meter spread and extended batt. Simultaneously, a second tow band of crimped continuous filaments with 100,000 filaments and total denier of 600,000 having a width of 0.25 meters is fed from container 8*b* through a series of feeding and spreading rolls 10*b* wrapping from the opposite position around the same 2-meter-wide batt-forming device 4 and engaged with conveyor 12*b* in the feeding zone at a speed equal to that of container 8*a*. A second spread, extended batt is formed similar to that of the first spread, extended batt. The two spread, extended batts form a structure with a cross-lapped angle about 90 degrees between the two batts. At this 90-degree angle, the structure has equal strength in both MID and CD directions, good stretch recovery properties, and high loft. In a continuous operation, these two tow bands from two separate feeding devices 8*a* and 8*b* make a continuous flat-tube structure as shown in FIG. 13, with basis weight of about 100 grams per square meter. This flat-tube structure has layers wrapping around in continuous tubular form which cannot be peeled off, in contrast to the case of the conventional cross-lapped structure.

Example 2

Referring to FIG. 1, a tow 1 of crimped continuous filaments with 100,000 filaments and total denier of 600,000 as in Example 1 is fed to the batt-forming device 4 at the same speed as in Example 1. A second tow 1 is also identical to that of Example 1 and is fed to the batt-forming device 4 as described in Example 1. The only exception is that the spread ratio is 4 instead of 8 as in Example 1. The resulting spread flat-tube structure has filament orientation of about a 27-degree angle relative to the CD direction. The flat-tube structure has a cross-lapped angle between layers of about 54 degrees.

Example 3

Referring to FIG. 1, a tow 1 of crimped continuous filaments with 100,000 filaments and total denier of 600,000 as in Example 1 is fed to the batt-forming device at speed as in Example 1. A second tow 1 identical to that of Example 1 is fed to batt-forming device 4 as described in Example 1. The only exception is that the spread ratio is 12 instead of 8 as in Example 1. The resulting spread flat-tube structure has a filament orientation of about a 56-degree angle relative to the CD direction, and a cross-lapped angle between layers of about 112 degrees.

The invention claimed is:

1. A substantially uniform flat-tube batt structure comprising at least one crimped and widened helically wrapped continuous filaments tow band.

2. The flat-tube batt structure of claim 1, comprising a single crimped and widened continuous filaments tow band which overlaps on the adjacent wrapped tow band.

3. The flat-tube structure of claim 2, wherein the widened tow band has a width of 2 meters.

4. The flat-tube structure of claim 1, wherein the filaments are substantially parallel and at an angle of 30 to 60° with the longitudinal axis of the flat-tube batt.

5. The flat-tube structure of claim 1, comprising multiple crimped and widened continuous filaments tow bands.

6. The flat-tube structure of claim 1, comprising multiple widened continuous filaments tow bands which overlap.

7. The flat-tube structure of claim 6, wherein the filaments in each widened tow band are substantially parallel, and are at an angle of 30 to 60 with the longitudinal axis of the flat-tube and form a fiber orientation between the widened overlapping bands of from 60 to 120°.

8. The flat-tube structure of claim 7, wherein the angle with the longitudinal axis is about 45° and the fiber orientation between widened overlapping band layers is about 90°.

9. The flat-tube structure of claim 5, wherein the each tow band has essentially the same thickness, density, and continuity across the width of the tow band.

10. The flat-tube structure of claim 6, wherein the tow bands contain separated small bundles which form gaps in the flat-tube structure.

11. The flat-tub structure of claim 7, wherein the tow bands each have 100,000 filaments and a total denier of 600,000.

12. The flat-tube structure of claim 1, comprising multiple widened continuous filaments tow bands which overlap on the adjacent wrapped tow bands.

13. The flat-tube structure of claim 1, which is stretchable.

* * * * *